US008490594B2

(12) United States Patent
Kitajima

(10) Patent No.: US 8,490,594 B2
(45) Date of Patent: Jul. 23, 2013

(54) OUTBOARD MOTOR

(75) Inventor: Kazuyuki Kitajima, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 902 days.

(21) Appl. No.: 12/629,169

(22) Filed: Dec. 2, 2009

(65) Prior Publication Data

US 2010/0132651 A1 Jun. 3, 2010

(30) Foreign Application Priority Data

Dec. 3, 2008 (JP) ..... 2008-308863
Dec. 3, 2008 (JP) ..... 2008-308868

(51) Int. Cl.
*F02N 1/00* (2006.01)

(52) U.S. Cl.
USPC ..... 123/185.3; 123/185.14

(58) Field of Classification Search
USPC ..... 123/185.3, 185.2, 185.1, 185.14
See application file for complete search history.

(56) References Cited

U.S. PATENT DOCUMENTS

| | | | | |
|---|---|---|---|---|
| 3,763,842 | A * | 10/1973 | Dooley et al. | 123/185.14 |
| 5,988,132 | A | 11/1999 | Watanabe | |
| 6,684,843 | B1 * | 2/2004 | Yoshida et al. | 123/185.2 |
| 6,739,303 | B2 * | 5/2004 | Harada et al. | 123/185.14 |
| 7,650,868 | B2 * | 1/2010 | Fujita et al. | 123/185.14 |
| 2002/0121257 | A1 * | 9/2002 | Morishige et al. | 123/185.3 |
| 2004/0016311 | A1 * | 1/2004 | Hashiba | 74/8 |
| 2004/0177823 | A1 | 9/2004 | Saito | |
| 2005/0199212 | A1 | 9/2005 | Saito | |
| 2006/0081209 | A1 * | 4/2006 | Hashiba | 123/185.3 |
| 2009/0107445 | A1 * | 4/2009 | Chigira et al. | 123/185.3 |
| 2009/0301425 | A1 * | 12/2009 | Sato et al. | 123/185.3 |

FOREIGN PATENT DOCUMENTS

| | | | |
|---|---|---|---|
| EP | 1 092 866 | A2 | 4/2001 |
| EP | 1 203 883 | A2 | 5/2002 |
| JP | 61-249897 | A | 11/1986 |
| JP | 63-92078 | U | 6/1988 |
| JP | 10-238440 | A | 9/1998 |
| JP | 2002-138929 | A | 5/2002 |
| JP | 2005-256620 | A | 9/2005 |

OTHER PUBLICATIONS

Official Communication issued in corresponding Japanese Patent Application No. 2008-308868, mailed on Sep. 4, 2012, and partial English translation thereof.

* cited by examiner

*Primary Examiner* — Willis R Wolfe, Jr.
*Assistant Examiner* — Anthony L Bacon
(74) *Attorney, Agent, or Firm* — Keating & Bennett, LLP

(57) ABSTRACT

An outboard motor includes an engine including a vertically extending crankshaft, a rope reel, a transmitting member, a force accumulation spiral spring, and an engine cover arranged to cover these components. The rope reel includes a plate portion arranged to be rotatable about the rotational center axis of the crankshaft and a rope winding portion provided integrally with the plate portion at the peripheral edge thereof and arranged to be wound with a rope to start the engine. The transmitting member is arranged to be rotatable about the rotational center axis of the crankshaft and to transmit rotation to the crankshaft. The force accumulation spiral spring is disposed on the opposite side of the engine with respect to the plate portion of the rope reel. The force accumulation spiral spring is arranged to accumulate a torque applied to the rope reel and transmit the torque to the transmitting member, first and second ends of the spring being fixed, respectively, to the rope reel and the transmitting member.

11 Claims, 13 Drawing Sheets

OUTBOARD MOTOR

BACKGROUND OF THE INVENTION

1. Field of the Invention

The present invention relates to an outboard motor and, in particular, to an outboard motor including a rope reel on which an engine starter rope is wound.

2. Description of Related Art

European Patent Application Publication No. EP 1092866 A2, for example, discloses an outboard motor including a rope reel on which an engine starter rope is wound.

The outboard motor disclosed in EP 1092866 A2 is arranged such that the rope reel is rotated when a user pulls a handle portion of the rope. The rotation of the rope reel is transmitted to the crankshaft and thereby the engine is started. The pulled-out rope is to be rewound by a force provided by a rewind spiral spring.

However, when starting the engine by pulling the rope, the user is required to pull the rope with a force exceeding a friction or resistance maximized at the compression point of the engine (top dead center of the piston). This makes it difficult to start the engine.

In order to reduce the resistance at engine start, it may be considered to increase the diameter of the rope winding portion of the rope reel. However, the amount of revolution of the engine decreases relative to the amount of pulling the rope, resulting in poor startability. In addition, the size of the engine cover of the outboard motor increases.

On the other hand, United States Patent Application Publication Nos. US 2004/0177823A1 and US 2005/0199212 A1 each disclose a general-purpose engine starter including a force accumulation spiral spring in addition to a rewind spiral spring, although not arranged for use in outboard motors.

In the general-purpose engine starter disclosed in US 2004/0177823 A1 and US 2005/0199212 A1, when the rope is pulled and thereby the rope reel is rotated, the force accumulation spiral spring is wound to be accumulated with a force. The crankshaft is rotated by the force accumulated in the force accumulation spiral spring, and thus the engine is started. This arrangement allows the user to experience a reduced resistance when pulling the rope at the start of the engine without increasing the diameter of the rope reel.

In the arrangement disclosed in US 2004/0177823 A1 and US 2005/0199212 A1, the rope reel includes a plate portion rotatable about the rotational center axis of the crankshaft and a rope winding portion provided integrally with the plate portion at the peripheral edge thereof. The engine starter rope is wound around the rope winding portion. The plate portion is disposed between the force accumulation spiral spring and the rewind spiral spring. The force accumulation spiral spring is considered to be disposed closer to the engine with respect to the plate portion, although this is not described explicitly in US 2004/0177823 A1 and US 2005/0199212 A1.

In the arrangement disclosed in US 2004/0177823 A1, the height position of the plate portion is approximately the same as that of the rope winding portion. In the arrangement disclosed in US 2005/0199212 A1, the rope winding portion is extended toward the force accumulation spiral spring (i.e., toward the engine) from the plate portion by the width of the force accumulation spiral spring. Consequently, the rope winding portion is disposed closer to the engine than the force accumulation spiral spring.

SUMMARY OF THE INVENTION

The inventor of preferred embodiments of the present invention described and claimed in the present application conducted an extensive study and research regarding an outboard motor, such as the one described above, and in doing so, discovered and first recognized new unique challenges and previously unrecognized possibilities for improvements as described in greater detail below.

That is, in the arrangement disclosed in US 2004/0177823 A1, the height position of the rope winding portion is separated from the engine by the width of the force accumulation spiral spring. Therefore, applying the structure disclosed in US 2004/0177823 A1 to outboard motors results in the height position of the rope winding portion increases being separated from the engine. This results in an increase in the size of the engine cover.

In the arrangement disclosed in US 2005/0199212 A1, the rope winding portion is arranged near the engine. It is therefore considered that applying the structure disclosed in US 2005/0199212 A1 to outboard motors allows the size of the engine cover to be reduced. However, the height position of the rope winding portion of the rope reel to which a force from the rope is applied directly is significantly different from the height position of the plate portion of the rope reel. This may result in poor mechanical strength of the rope reel against the force applied by the rope. In particular, it may be considered that outboard motors use resin materials for components such as rope reels mainly for the purpose of weight saving. In this case, it is especially necessary to design the rope reel to be strengthened mechanically.

In order to overcome the previously unrecognized and unsolved challenges and possibilities for improvements described above, a preferred embodiment of the present invention provides an outboard motor that includes an engine including a vertically extending crankshaft, a rope reel, a transmitting member, a force accumulation spiral spring, and an engine cover arranged to cover these components. The rope reel includes a plate portion arranged to be rotatable about the rotational center axis of the crankshaft and a rope winding portion provided integrally with the plate portion at the peripheral edge thereof and arranged to be wound with a rope for the start of the engine. The transmitting member is arranged to be rotatable about the rotational center axis of the crankshaft and to transmit rotation to the crankshaft. The force accumulation spiral spring is disposed on the opposite side of the engine with respect to the plate portion of the rope reel. The force accumulation spiral spring is arranged to accumulate a torque applied to the rope reel and transmit the torque to the transmitting member. First and second ends of the spring are fixed, respectively, to the rope reel and the transmitting member.

In this outboard motor, the force accumulation spiral spring is disposed on the opposite side of the engine with respect to the plate portion of the rope reel. It is therefore easy to dispose the rope winding portion at a lower position. This allows the size of the engine cover to be reduced. Also, the rope winding portion is not required to be extended largely toward the engine from the plate portion. Therefore, the rope reel can have a sufficient mechanical strength against a force applied by the rope.

The outboard motor preferably further includes a fixed member fixed non-rotationally with respect to the engine, and a rewind spiral spring arranged to rewind the rope. First and second ends of the rewind spiral spring are fixed, respectively, to the rope reel and the fixed member. In this arrangement, the rewind spiral spring is preferably disposed on the opposite side of the engine with respect to the plate portion of the rope reel. With this arrangement, the plate portion of the rope reel is disposed at a lower position closer to the engine than both of the force accumulation spiral spring and the rewind spiral spring. It is therefore easy to dispose the rope winding portion at a lower position closer to the engine. Consequently, the rope winding portion is not required to be extended largely toward the engine from the plate portion and thereby can have a sufficient mechanical strength.

It is preferred that the rope reel further include a cylindrical standing wall portion, that the fixed member include a cylindrical support wall portion, and that the outer peripheral surface of the standing wall portion of the rope reel is supported externally and rotatably by the inner peripheral surface of the support wall portion of the fixed member. With this arrangement, the inner peripheral surface of the support wall portion of the fixed member is brought into contact with the outer peripheral surface of the standing wall portion of the rope reel to guide rotation of the rope reel about the rotational center axis. This can prevent the rope reel from being inclined with respect to the rotational center axis. This allows the rope reel to be rotated reliably about the rotational center axis and thereby can prevent the rope reel from being applied with an extra or excess force. As a result, the durability of the rope reel can be improved.

In the arrangement mentioned above, one end of the force accumulation spiral spring may be fixed to the inner peripheral surface of the standing wall portion of the rope reel.

The rewind spiral spring is preferably disposed closer to the engine than the force accumulation spiral spring. In this case, the rewind spiral spring is preferably disposed so as to overlap the force accumulation spiral spring in the direction of the crankshaft. With this arrangement, the rewind spiral spring and the force accumulation spiral spring are provided in a vertically overlapped manner. It is therefore possible to minimize and prevent the lateral expansion of the space that is occupied by the rewind spiral spring and the force accumulation spiral spring over the plate portion. This allows the engine cover to have a round-off shape.

In the case above, the outside diameter of the force accumulation spiral spring is preferably smaller than the outside diameter of the rewind spiral spring. With this arrangement, the rope reel, rewind spiral spring, and force accumulation spiral spring can be disposed in descending order of diameter from bottom to top. This allows the engine cover to have a round-off shape.

In another preferred embodiment of the present invention, the rewind spiral spring is disposed so as to surround the outer periphery of the force accumulation spiral spring. With this arrangement, the height of the outboard motor (height of the engine cover) can be reduced.

In the case above, the height of the end surface of the rewind spiral spring on the opposite side of the engine is preferably smaller than the height of the end surface of the force accumulation spiral spring on the opposite side of the engine. With this arrangement, the profile line defined by the rope reel, rewind spiral spring, and force accumulation spiral spring narrows from bottom to top. This allows the engine cover to have a round-off shape.

The outboard motor preferably further includes a handle on the rope disposed on a lateral portion of the engine cover. In this case, the rope winding portion is disposed, for example, closer to the engine than the rewind spiral spring and the force accumulation spiral spring, and the handle is disposed closer to the engine than the rope winding portion. Since the plate portion of the rope reel is disposed closer to the engine than the force accumulation spiral spring, the distance between the plate portion and the handle is small. It is therefore possible to dispose the rope winding portion at a position near the handle without being extended largely toward the engine from the plate portion. This allows the difference in the height position between the handle and the rope winding portion to be reduced while the rope reel is strengthened mechanically.

The engine cover preferably includes a ceiling wall having a slant portion slanted downward toward the front thereof. This can prevent interference between the hull as well as other structures and the engine cover when the outboard motor is tilted up. That is, the size and shape of the engine cover are restricted so that interference with the hull as well as other structures can be avoided easily. The engine cover preferably further includes a front wall coupled to the front edge of the ceiling wall and having a flat portion. In this case, the outboard motor preferably further includes a handle housing portion disposed in the flat portion and arranged to house the handle therein, and a seal member disposed between the handle housing portion and the inner wall surface of the flat portion. This allows the clearance between the handle housing portion and the engine cover to be sealed, which can prevent intrusion of water into the engine cover. In particular, the sealing structure can be provided at the flat portion, whereby a sufficient sealing performance can be ensured.

Since the ceiling wall of the engine cover is slanted toward the front thereof, the flat portion in the front wall cannot be provided at a high position. Therefore, the height position of the handle housing portion is restricted. Even under such circumstances, because the rope winding portion can be disposed at a lower position closer to the engine without sacrificing the mechanical strength of the rope reel, the difference in the height position between the rope winding portion and the handle housing portion is small. Therefore, the pulling force applied to the rope can be transmitted efficiently to the rope reel and the rope reel can be rotated stably.

It is preferred that the outside diameter of the rope winding portion be smaller than the outside diameter of a flywheel fixed to the crankshaft. With this arrangement, the size of the engine cover can be reduced. Since the force accumulation spiral spring is provided, the user experiences a reduced resistance at the start of the engine. Therefore, the user does not experience a large resistance at the start of the engine even if the outside diameter of the rope winding portion may be smaller than that of the flywheel. This allows the size of the engine cover to be reduced without the user experiencing an increased resistance at the start of the engine.

The width of the force accumulation spiral spring may preferably be greater than the width of the rewind spiral spring.

Still another preferred embodiment of the present invention provides an outboard motor that includes an engine including a vertically extending crankshaft and a flywheel fixed to the crankshaft, a rope reel having an outside diameter smaller than that of the flywheel, a transmitting member, a force accumulation spiral spring, and an engine cover arranged to cover these components. The rope reel includes a plate portion arranged to be rotatable about the rotational center axis of the crankshaft and a rope winding portion provided integrally with the plate portion at the peripheral edge thereof and arranged to be wound with a rope for the start of the engine. The transmitting member is arranged to be rotatable about the rotational center axis of the crankshaft and to transmit rotation to the crankshaft. The force accumulation spiral spring is arranged to accumulate a torque applied to the rope reel and transmit the torque to the transmitting member. First and second ends of the spring are fixed, respectively, to the rope reel and the transmitting member.

With the arrangement above, the size of the engine cover can be reduced. Because the force accumulation spiral spring is provided, the user is able to experience and enjoy a reduced resistance at the start of the engine. Therefore, the user does not experience a large resistance at the start of the engine even if the outside diameter of the rope winding portion may be smaller than that of the flywheel. This allows the size of the engine cover to be reduced without the user experiencing an increased resistance at the start of the engine.

The above-described one or more characteristics may be combined arbitrarily with the outboard motor according to this preferred embodiment. For example, the outboard motor may further include a fixed member fixed non-rotationally with respect to the engine, and a rewind spiral spring arranged to rewind the rope, first and second ends of the spring being fixed, respectively, to the rope reel and the fixed member.

Other elements, features, steps, characteristics and advantages of the present invention will become more apparent from the following detailed description of the preferred embodiments with reference to attached drawings.

DETAILED DESCRIPTION OF THE PREFERRED EMBODIMENTS

First Preferred Embodiment

Figure 1:
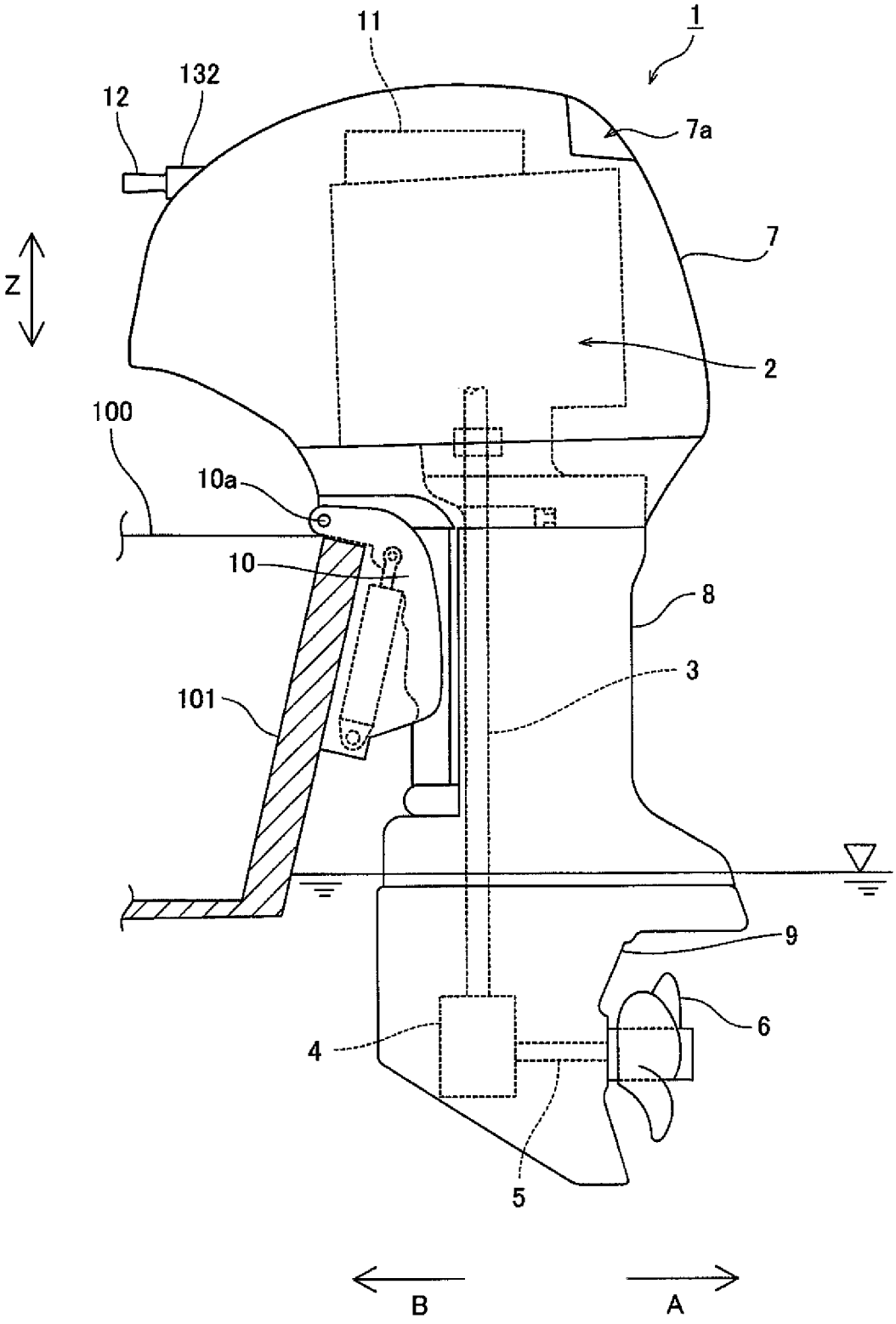
FIG. 1 is a schematic view showing the overall arrangement of an outboard motor according to a first preferred embodiment of the present invention.

FIG. 1 is a side view showing the overall arrangement of an outboard motor according to a first preferred embodiment of the present invention.

The outboard motor 1 is mounted via a clamp bracket 10 on a stern board 101 provided on the side of the reverse drive direction (indicated by the arrow A) of the hull 100. The clamp bracket 10 supports the outboard motor 1 so as to be vertically swingable about a tilting shaft 10*a* with respect to the hull 100.

The outboard motor 1 includes an engine 2, a drive shaft extending in the vertical direction (in the Z direction), a forward-reverse switching mechanism 4 coupled to the lower end of the drive shaft 3, a propeller shaft 5 coupled to the forward-reverse switching mechanism 4 and extending horizontally, and a propeller 6 fixed at the rear end portion of the propeller shaft 5. The drive shaft 3 is rotated by a driving force generated by the engine 2. The engine 2 is housed in an engine cover 7. An upper case 8 and a lower case 9 are disposed below the engine cover 7, and the drive shaft 3 and the forward-reverse switching mechanism 4 as well as the propeller shaft 5 are housed in the cases 8 and 9. A ventilation hole 7*a* is provided in a lateral portion of the engine cover 7 on the side of the reverse drive direction (indicated by the arrow A). Air is introduced and supplied to the engine 2 in the engine cover 7 via the ventilation hole 7*a*.

When the drive shaft 3 is rotated by a driving force from the engine 2, the rotation is transmitted to the propeller shaft 5 via the forward-reverse switching mechanism 4. This causes the propeller 6 to be rotated. The forward-reverse switching mechanism 4 is arranged to be switchable among forward drive, neutral, and reverse drive states. In the forward drive state, the forward-reverse switching mechanism 4 converts the rotation of the drive shaft 3 into the forward drive rotation of the propeller shaft 5. In the neutral state, the forward-reverse switching mechanism 4 does not transmit the rotation of the drive shaft 3 to the propeller shaft 5. In the reverse drive state, the forward-reverse switching mechanism 4 converts the rotation of the drive shaft 3 into the reverse drive rotation of the propeller shaft 5. The forward drive rotation is a rotation in a direction in which a propulsive force for propelling the hull 100 in the forward drive direction (indicated by the arrow B) is generated by the rotation of the propeller 6. The reverse drive rotation is a rotation in the opposite direction of the forward drive rotation, that is, in a direction in which a propulsive force for propelling the hull 100 in the reverse drive direction (indicated by the arrow A) is generated by the rotation of the propeller 6.

Inside the engine cover 7, an engine starter 11 is provided. The engine starter 11 is arranged to be operated by a user to manually start the engine 2. A handle 12 on a rope 14 for the engine starter 11 is disposed on a lateral portion on the side of forward drive direction B (more properly in the front wall portion) of the engine cover 7. The user can start the engine 2 by pulling the handle 12.

Figure 2:
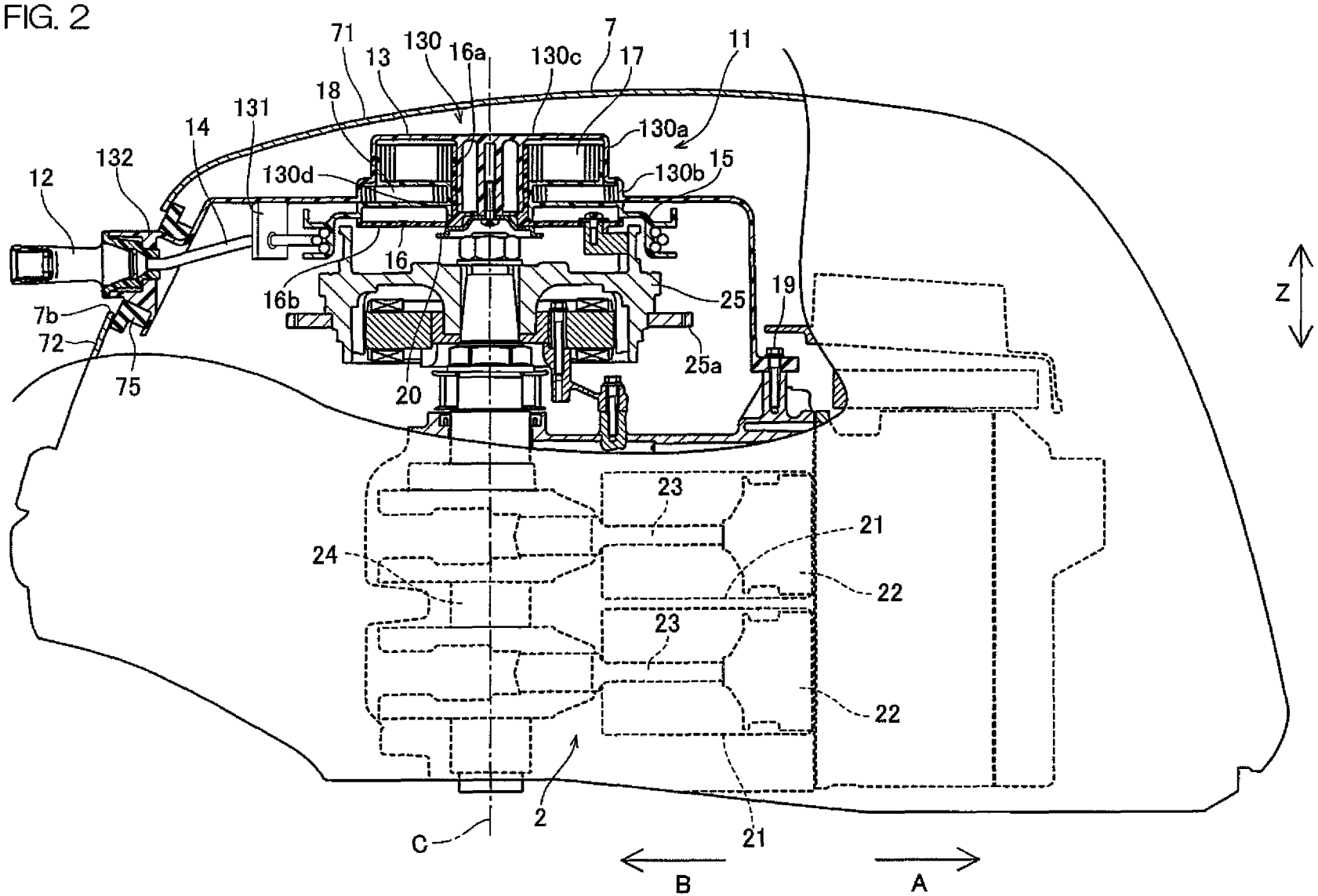
FIG. 2 is a partial cross-sectional view showing the arrangement inside the engine cover of the outboard motor.

FIG. 2 is a partial cross-sectional view showing the inside of the engine cover 7 of the outboard motor 1. The engine 2 is an internal combustion engine including two vertically arranged cylinders 21 and pistons 22 that move horizontally in the respective cylinders 21 in a reciprocating manner. Each piston 22 is coupled via a connecting rod 23 to a crankshaft 24 extending in the vertical direction (in the Z direction). The horizontal reciprocating motion of each piston 22 is converted into a rotational motion of the crankshaft 24 through each connecting rod 23 and the crankshaft 24. The lower end portion of the crankshaft 24 is connected to the drive shaft 3 (see FIG. 1). Also, a flywheel 25 arranged to stabilize the revolution of the engine 2 is fixed at the upper end of the crankshaft 24. The outer peripheral portion of the flywheel 25 is fitted with a ring gear 25*a*. When starting the engine 2 using a starter motor (not shown), a gear (not shown) driven by the starter motor is engaged with the ring gear 25*a*. When the starter motor is driven in this state, the crankshaft 24 is rotated and the engine 2 is started.

Figure 3:
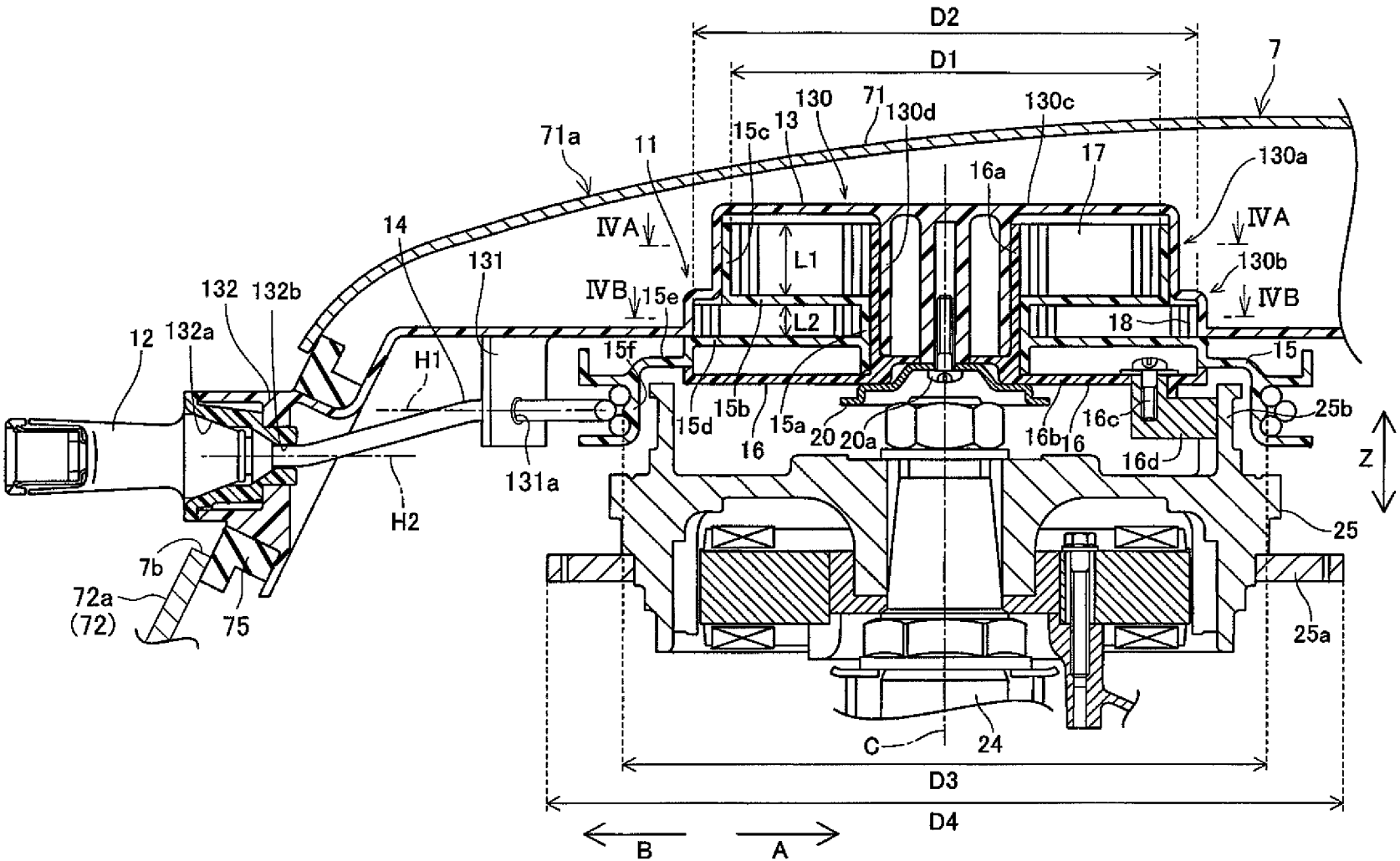
FIG. 3 is an enlarged cross-sectional view showing a portion of the arrangement shown in FIG. 2 in an enlarged manner.

FIG. 3 is a cross-sectional view showing a portion of the arrangement shown in FIG. 2 in an enlarged manner. The engine starter 11, which is arranged to manually start the engine 2, is disposed above the flywheel 25. The engine starter 11 includes a recoil case 13, a rope reel 15, a cam plate 16, a force accumulation spiral spring 17, and a rewind spiral spring 18. The recoil case 13 is preferably made of, for example, resin material and is fixed to the engine 2 so as to be non-rotational with respect to the engine 2 and the engine cover 7. The rope reel 15 is preferably made of, for example, resin material and is arranged to be wound with the rope 14 as well as to be rotatable about the rotational center axis C of the crankshaft 24. The cam plate 16 is made of, for example, resin material and is arranged to be rotatable about the rotational center axis C. The force accumulation spiral spring 17 is arranged to accumulate a torque applied by the rope reel 15. The rewind spiral spring 18 is arranged to rewind the rope 14 in a pulled-out state. The recoil case 13 and the cam plate 16 are, respectively, examples of a "fixed member" and a "transmitting member" according to one preferred embodiment of the present invention.

The recoil case 13 is fixed to the upper surface of the engine 2 using a screw 19, for example (see FIG. 2). The recoil case 13 has a housing portion 130, a guide portion 131, and a handle housing portion 132 that are formed integrally. The housing portion 130 is arranged to house therein the rope reel 15, cam plate 16, force accumulation spiral spring 17, and rewind spiral spring 18, etc. The guide portion 131 is arranged to guide the rope 14 to be pulled out and rewound. The handle housing portion 132 is arranged to house and hold therein the handle 12 on the rope 14.

The housing portion 130 includes a force accumulation spiral spring housing portion 130*a* arranged to house therein the force accumulation spiral spring 17 and a rewind spiral spring housing portion 130*b* arranged to house therein the rewind spiral spring 18. The housing portion 130 further includes a rotary shaft portion 130*d* protruding downward from the upper surface portion 130*c* and arranged to rotatably support the rope reel 15 and the cam plate 16. The force accumulation spiral spring housing portion 130*a* and the rewind spiral spring housing portion 130*b* each preferably have a cylindrical shape. The diameter of the force accumulation spiral spring housing portion 130*a* is smaller than that of the rewind spiral spring housing portion 130*b*. Therefore, the outside diameter D1 of the force accumulation spiral spring 17 is smaller than the outside diameter D2 of the rewind spiral spring 18. The axis of the rotary shaft portion 130*d* coincides with the rotational center axis C of the crankshaft 24.

The guide portion 131 and the handle housing portion 132 are disposed on a passage route of the rope 14. The guide portion 131 and the handle housing portion 132 are arranged to serve, respectively, as first and second guide portions to be brought into contact with the rope 14 to guide the movement of the rope when pulled by the user or rewound.

The rope reel 15 includes a cylindrical inner cylinder portion 15*a*, a disk-shaped force accumulation spiral spring support portion 15*b*, a cylindrical standing wall portion 15*c*, a disk-shaped plate 15*d*, a stepped portion 15*e*, and a rope winding portion 15*f* that are formed integrally. The force accumulation spiral spring support portion 15*b* is arranged so as to extend outward from the upper end portion of the inner cylinder portion 15*a*. The standing wall portion 15*c* protrudes upward from the outer peripheral portion of the force accumulation spiral spring support portion 15*b*. The plate 15*d* is arranged so as to extend outward from the center of the inner cylinder portion 15*a* and is disposed below the force accumulation spiral spring support portion 15*b*. The stepped portion 15*e* is arranged so as to extend downward from the outer peripheral portion of the plate 15*d* and further extend outward. The rope winding portion 15*f* is provided at the peripheral edge of the stepped portion 15*e*. The outer peripheral surface of the standing wall portion 15*c* of the rope reel 15 is supported externally and rotatably by the inner peripheral surface of the force accumulation spiral spring housing portion 130*a*. The plate 15*d* is an example of a "plate portion" according to one preferred embodiment of the present invention, and the force accumulation spiral spring housing portion 130*a* is an example of a "support wall portion" according to one preferred embodiment of the present invention.

The cam plate 16 includes a cylindrical inner cylinder portion 16*a* and a plate 16*b* located in the lower portion of the inner cylinder portion 16*a* that are formed integrally. The inner cylinder portion 16*a* of the cam plate 16 is fitted externally and rotatably on the rotary shaft portion 130*d* of the recoil case 13. The inner cylinder portion 15*a* of the rope reel 15 is fitted externally and rotatably on the inner cylinder portion 16*a* of the cam plate 16. The rope winding portion 15*f* is wound with the rope 14 that is to be pulled by the user to manually start the engine 2. The outside diameter D3 of the rope winding portion 15*f* is smaller than the outside diameter of the flywheel 25 (i.e., the outside diameter D4 of the ring gear 25*a*).

The force accumulation spiral spring 17 and the rewind spiral spring 18 are both disposed on the opposite side of the engine 2 with respect to the plate 15*d* of the rope reel 15. Specifically, the force accumulation spiral spring 17 is disposed in a space that is surrounded by the force accumulation spiral spring support portion 15*b* and standing wall portion 15*c* of the rope reel 15, the inner cylinder portion 16*a* of the cam plate 16, and the upper surface portion 130*c* of the recoil case 13. The rewind spiral spring 18 is disposed in a space that is surrounded by the force accumulation spiral spring support portion 15*b*, plate 15*d*, and inner cylinder portion 15*a* of the rope reel 15 and the rewind spiral spring housing portion 130*b*. Therefore, the rewind spiral spring 18 is disposed lower (closer to the engine 2) than the force accumulation spiral spring 17. Further, the rewind spiral spring 18 is disposed so as to overlap the force accumulation spiral springs 17 and 18 in the direction of the crankshaft (in which the crankshaft 24 extends).

Figure 4B:
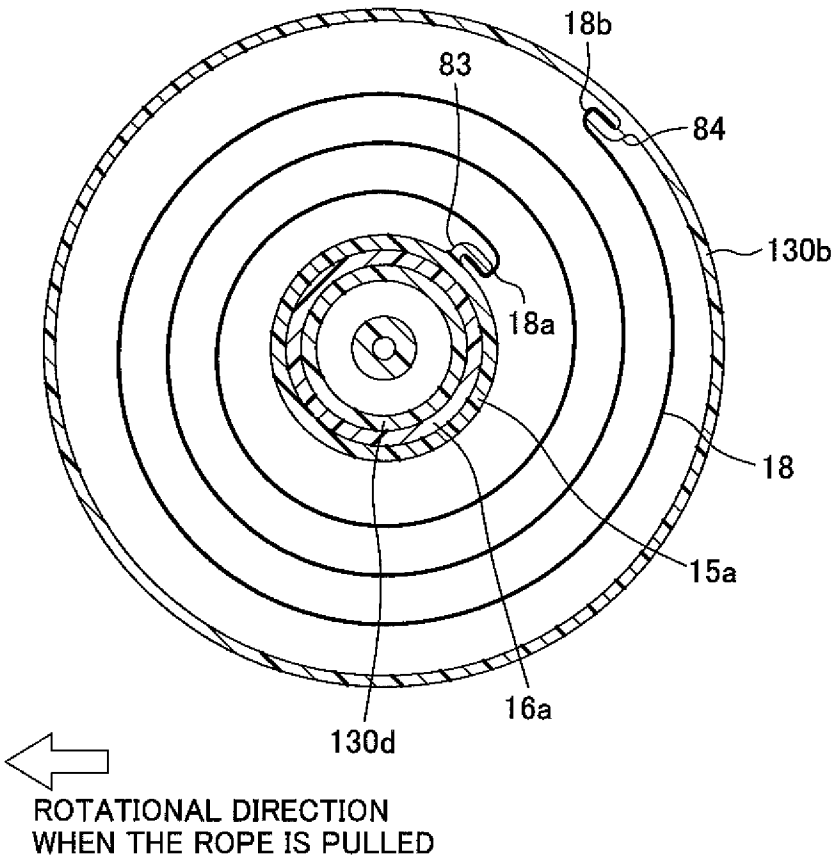
FIG. 4B is a cross-sectional view along the section line IVB-IVB in FIG. 3.
Figure 4A:
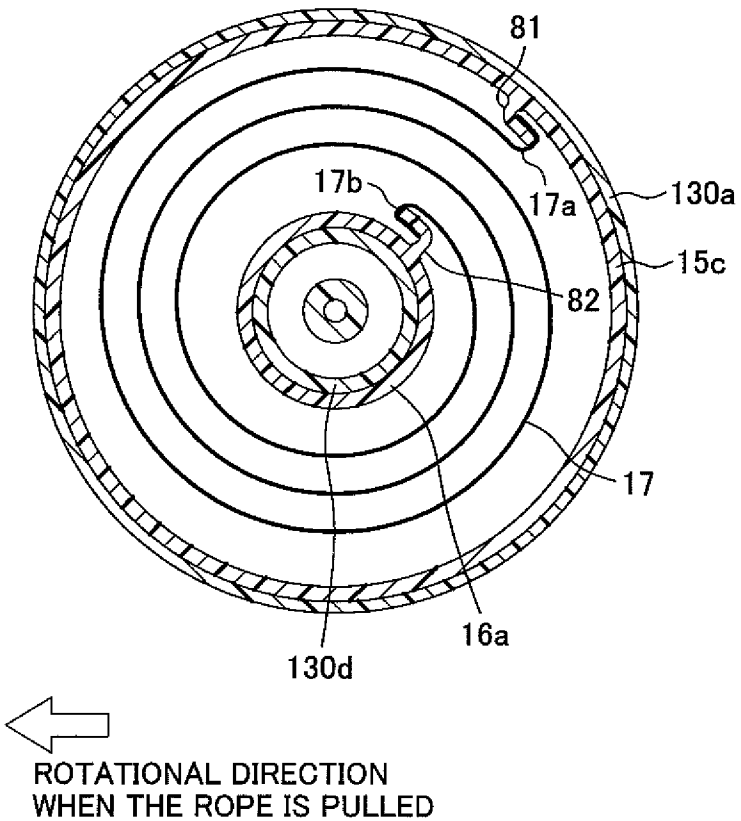
FIG. 4A is a cross-sectional view along the section line IVA-IVA in FIG. 3.

FIG. 4A is a cross-sectional view along the section line IVA-IVA in FIG. 3, and FIG. 4B is a cross-sectional view along the section line IVB-IVB in FIG. 3. A first end (outer end) 17*a* and a second end (inner end) 17*b* of the force accumulation spiral spring 17 are fixed, respectively, to the inner surface of the cylindrical standing wall portion 15*c* of the rope reel 15 and the outer surface of the inner cylinder portion 16*a* of the cam plate 16, with the spring 17 being supported by the force accumulation spiral spring support portion 15*b*. More specifically, the outer end 17*a* and the inner end 17*b* each preferably have a hook shape. Hooks 81 and 82 are provided, respectively, on the inner surface of the standing wall portion 15*c* and the outer surface of the inner cylinder portion 16*a*. The outer end 17*a* and the inner end 17*b* are engaged, respectively, with the hooks 81 and 82. Also, a first end (inner end) 18*a* and a second end (outer end) 18*b* of the rewind spiral spring 18 are fixed, respectively, to the outer surface of the inner cylinder portion 15*a* of the rope reel 15 and the inner surface of the rewind spiral spring housing portion 130*b*. More specifically, the inner end 18*a* and the outer end 18*b* each preferably have a hook shape. Hooks 83 and 84 are provided, respectively, on the outer surface of the inner cylinder portion 15*a* and the inner surface of the rewind spiral spring housing portion 130*b*. The inner end 18*a* and the outer end 18*b* are engaged, respectively, with the hooks 83 and 84.

Also, as shown in FIG. 3, a pressing member 20 is fixed from downward using a screw 20*a*, for example, with the rope reel 15, cam plate 16, force accumulation spiral spring 17, and rewind spiral spring 18 being fitted in the recoil case 13.

The guide portion 131 protrudes downward from the recoil case 13 and has a guide hole 131*a* for passage of the rope 14 therethrough. The rope winding portion 15*f* and the guide hole 131*a* in the guide portion 131 are disposed at the same height position H1. Also, the handle housing portion 132 is fixed in the vicinity of a hole 7*b* (see FIG. 3) that is formed in the lateral surface of the engine cover 7 on the side of the hull 100 (see FIG. 1). The handle housing portion 132 has a holding portion 132*a* in which the handle 12 is housed and a guide hole 132*b* arranged to guide the rope 14 therethrough. The holding portion 132*a* and the guide hole 132*b* are disposed at the same height position H2. The height position H2 of the holding portion 132*a* and the guide hole 132*b* is lower (closer to the engine 2) than the height position H1 of the rope winding portion 15*f* and the guide hole 131*a*. This causes the rope 14 to be inclined at a predetermined angle from the guide hole 131*a* to the handle housing portion 132.

In more detail, the rope 14 extends horizontally from the rope winding portion 15*f* to the guide hole 131*a* of the guide portion 131, while inclined at a predetermined angle from the guide hole 131*a* of the guide portion 131 to the guide hole 132*b* of the handle housing portion 132. The rope 14 also extends horizontally from the guide hole 132*b* of the handle housing portion 132 to the handle 12. Thus, the extending direction (horizontal) of the rope 14 between the rope winding portion 15*f* and the guide hole 131*a* is different from the extending direction (inclined) of the rope 14 between the guide hole 131*a* and the guide hole 132*b* when viewed laterally. The extending direction (inclined) of the rope 14 between the guide hole 131*a* and the guide hole 132*b* is also different from the extending direction (horizontal) of the rope 14 between the guide hole 132*b* and the handle 12.

Figure 5:
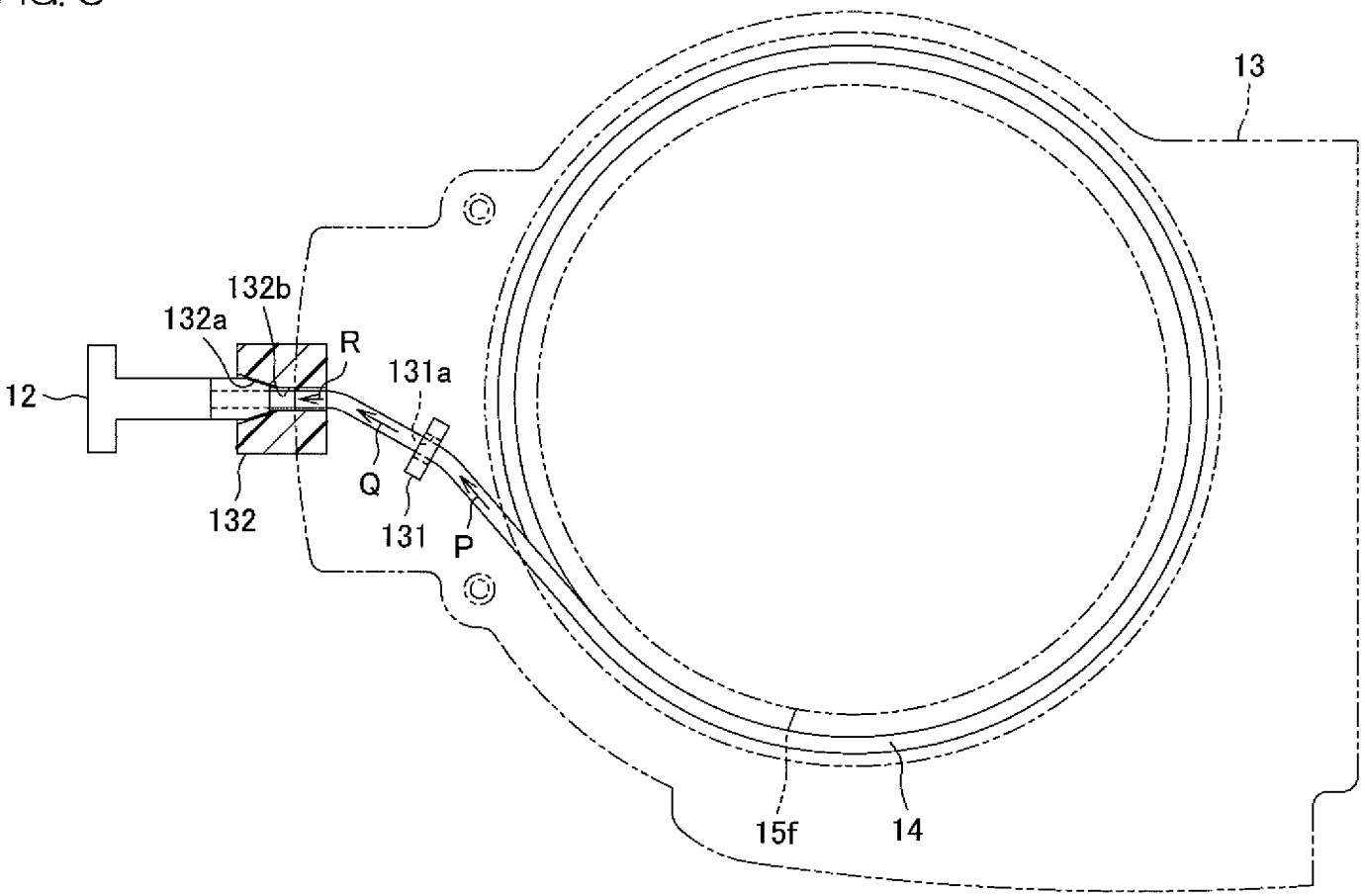
FIG. 5 is a schematic plan view illustrating a passage route of a rope.

Further, as shown in FIG. 5, the extending direction P of the rope 14 between the rope winding portion 15*f* and the guide hole 131*a* is different from the extending direction Q of the rope 14 between the guide hole 131*a* and the guide hole 132*b* when viewed from above. The extending direction Q of the rope 14 between the guide hole 131*a* and the guide hole 132*b* is also different from the extending direction R of the rope 14 between the guide hole 132*b* and the handle 12.

As shown in FIG. 3, the engine cover 7 includes a ceiling wall 71 having a slant portion 71*a* slanted downward toward the front thereof. It is therefore possible to prevent interference between the hull 100 as well as structures provided on the hull 100 and the engine cover 7 when the outboard motor 1 is tilted up. The engine cover 7 further includes a front wall 72 coupled to the front edge of the ceiling wall 71. The front wall 72 has a flat portion 72*a* slanted downward toward the front thereof at a slant angle greater than that of the slant portion 71*a*. The hole 7*b* is formed in the flat portion 72*a*, and the handle housing portion 132 is disposed so as to pass through the hole 7*b*. An annular seal member 75 is disposed between the handle housing portion 132 and the inner wall surface of the flat portion 72*a* so as to cover the entire peripheral edge of the hole 7*b*. The seal member 75 is preferably made of, for example, elastic material such as rubber and is sandwiched and held between the recoil case 13 and the inner wall surface of the engine cover 7 in a compressed manner. This defines a sealing structure that prevents intrusion of water into the engine cover 7 from outside. Since the sealing structure is provided at the flat portion 72*a* of the engine cover 7, a sufficient sealing performance can be ensured.

As best shown in FIG. 3, the width L1 of the force accumulation spiral spring 17 is greater than the width L2 of the rewind spiral spring 18. The force of the spiral springs depends on the width and thickness thereof. Therefore, if spiral springs having the same thickness are used as the force accumulation spiral spring 17 and the rewind spiral spring 18, the width L1 of the force accumulation spiral spring 17, which is required to provide a greater force, is greater than the width L2 of the rewind spiral spring 18. If the displacement of the engine 2 is small, the force accumulation spiral spring 17 may provide a smaller force and thus the width L1 of the force accumulation spiral spring 17 may be almost the same as the width L2 of the rewind spiral spring 18.

The rewind spiral spring 18 is provided for the purpose of rewinding the rope 14, which has a predetermined length to start the engine 2. For this purpose, the spiral spring is required to have a length sufficient for rewinding, resulting in an increase in the outside diameter D2. Rewinding does not require a great force, on the other hand, and thus the width L2 may be small.

The force accumulation spiral spring 17 is provided for the purpose of rotating the crankshaft 24. In particular, if the displacement of the engine 2 is large, a greater force is required to start the engine, resulting in an increase in the width L2 (as well as the thickness). The spiral spring does not require a great length, on the other hand, as long as it can start the engine, and thus the outside diameter D1 may be small.

Figure 6:
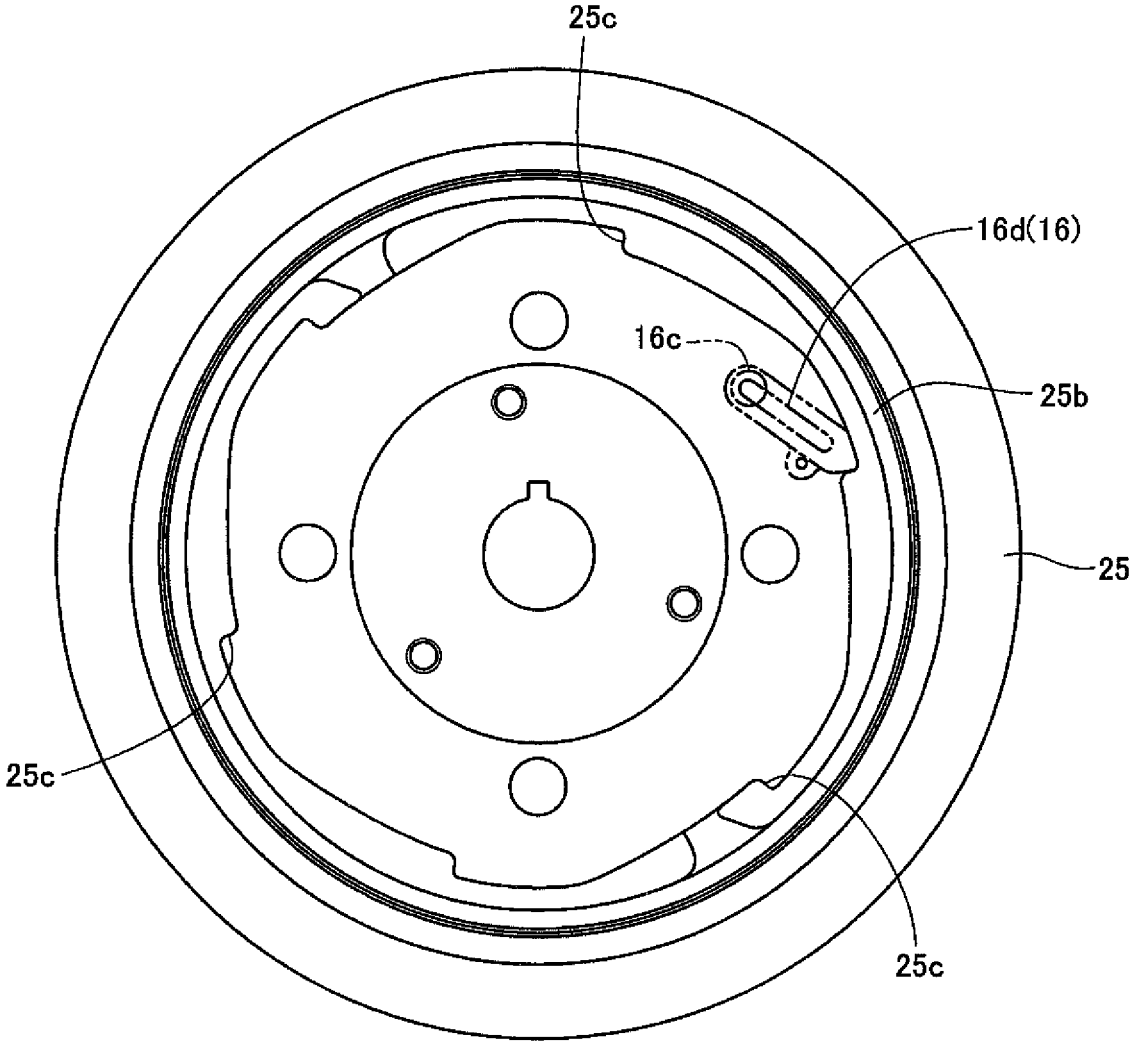
FIG. 6 is a plan view of a flywheel when viewed from above.

As shown in FIG. 3, an engagement nail 16*d* rotatable about a rotary shaft 16*c* is provided on the cam plate 16 so as to protrude toward the flywheel 25. The upper portion of the flywheel 25 is provided with a cylindrical protruding portion 25*b*, and multiple engageable recessed portions 25*c* (see FIG. 6) are arranged on the inner surface of the protruding portion 25*b* in a mutually spaced manner in the circumferential direction. As shown in FIG. 6, when manually starting the engine 2, the engagement nail 16*d* is engaged with the engageable recessed portions 25*c*, so that the torque of the engine starter 11 is transmitted to the flywheel 25. An elastic member (e.g., spring member, not shown) arranged to provide a torque to the engagement nail 16*d* is arranged to press the leading end portion of the engagement nail 16*d* against the inner surface of the protruding portion 25*b*. There is further provided a retraction mechanism (not shown) arranged to retract the engagement nail 16*d* from the inner surface of the protruding portion 25*b* when starting of the engine 2 is completed and then the flywheel 25 starts rotating together with the crankshaft 24.

Next will be described the operation when manually starting the engine of the outboard motor 1.

When the handle 12 is pulled by a user, the rope 14 wound around the rope reel 15 is pulled out, whereby the rope reel 15 is rotated. In this case, the first end (inner end) 18*a* of the rewind spiral spring 18 is rotated together with the inner cylinder portion 15*a*, while the second end (outer end) 18*b* is kept in a non-rotated state by the rewind spiral spring housing portion 130*b* of the recoil case 13 (see FIG. 4B). This causes the rewind spiral spring 18 to be wound up. The one end (outer end) 17*a* of the force accumulation spiral spring 17 is also rotated together with the standing wall portion 15*c*, while the other end (inner end) 17*b* is rotated together with the inner cylinder portion 16*a* of the cam plate 16. The rotation of the cam plate 16 is restricted by the engagement nail 16*d* being engaged with the engageable recessed portions 25*c* of the flywheel 25. Subsequently, the first end (outer end) 17*a* of the force accumulation spiral spring 17 is rotated together with the standing wall portion 15*c*, while the second end (inner end) 17*b* is kept in a non-rotated state by the inner cylinder portion 16*a* of the cam plate 16. This causes the force accumulation spiral spring 17 to be wound up and a torque applied to the rope reel 15 to be accumulated in the force accumulation spiral spring 17.

The force accumulated in the force accumulation spiral spring 17 tries to rotate the cam plate 16 in the rotational direction of the rope reel 15 (in the rotational direction when the rope 14 is pulled out). This causes the force accumulated in the force accumulation spiral spring 17 to be transmitted to the crankshaft 24 via the cam plate 16 and the flywheel 25. If the force accumulated in the force accumulation spiral spring 17 is smaller than a resistance generated in a compression process of the engine 2, the pistons 22 cannot exceed their top dead center. Therefore, the engine 2, crankshaft 24, and flywheel 25 are not activated, and thus the cam plate 16 engaged with the flywheel 25 is also not activated. In this state, the force accumulation spiral spring 17 is wound by the pulled-out amount of the rope 14 and a force is accumulated in the force accumulation spiral spring 17.

When the rope 14 is further pulled out and the force accumulated in the force accumulation spiral spring 17 exceeds a resistance generated in a compression process of the engine 2, the pistons 22 exceed their top dead center. This causes the energy accumulated in the force accumulation spiral spring 17 to be released and the crankshaft 24 is rotated by the energy. The engine 2 is consequently started.

When the user loses his/her hold on the handle 12, the rope reel 15 is rotated by force of the rewind spiral spring 18 in the reverse direction and thereby the rope 14 is rewound.

In the present first preferred embodiment, the force accumulation spiral spring 17 is disposed on the opposite side of the engine 2 with respect to the plate 15*d* of the rope reel 15, as mentioned above. It is therefore not necessary to bring the rope winding portion 15*f* of the rope reel 15 closer to the handle 12 by the width L1 of the force accumulation spiral spring 17 from the height position of the plate 15*d* of the rope reel 15. That is, it is easy to dispose the rope winding portion 15*f* at a lower position even if the rope winding portion 15*f* may not be extended largely to cover the force accumulation spiral spring 17. This allows the size of the engine cover 7 to be reduced. Also, because the rope winding portion 15*f* is not required to be extended largely from the plate 15*d* to cover the force accumulation spiral spring 17, the rope reel 15 can have a sufficient mechanical strength against a force applied by the rope 14. In particular, even if portions such as the rope reel 15 may be made of resin material mainly for the purpose of weight saving, the rope reel 15 can have a sufficient mechanical strength.

Also, in the present first preferred embodiment, not only the force accumulation spiral spring 17 but also the rewind spiral spring 18, preferably are disposed on the opposite side of the engine 2 with respect to the plate 15*d* of the rope reel 15, as mentioned above. Thus, the plate 15*d* is disposed lower (closer to the engine 2) than the force accumulation spiral spring 17 and the rewind spiral spring 18. Therefore, the rope winding portion 15*f* is not required to be extended largely from the plate 15*d*, whereby it is easy to dispose the rope winding portion 15*f* at a lower position closer to the engine 2. Accordingly, the rope winding portion 15*f*, which is not required to be extended largely toward the engine from the plate, can have a sufficient mechanical strength.

Further, in the present first preferred embodiment, the outer peripheral surface of the standing wall portion 15*c* of the rope reel 15 is supported externally by the inner peripheral surface of the force accumulation spiral spring housing portion 130*a*, as mentioned above. With this arrangement, the inner peripheral surface of the force accumulation spiral spring housing portion 130*a* is brought into contact with the outer peripheral surface of the standing wall portion 15*c* of the rope reel 15 to guide rotation of the rope reel 15 about the rotational center axis C. This can prevent the rope reel 15 from being inclined with respect to the rotational center axis C. This allows the rope reel 15 to be rotated reliably about the rotational center axis C and thereby can prevent the rope reel 15 from being applied with an extra or excess force. As a result, the durability of the rope reel 15 can be improved.

In addition, the rotation of the rope reel 15 is guided internally by the outer surface of the inner cylinder portion 16*a* of the cam plate 16 as well as externally by the inner peripheral surface of the force accumulation spiral spring housing portion 130*a*. With this arrangement, the rope reel 15, the rotation of which is guided within a wide range along the rotational center axis C, can be rotated stably. In particular, the inner peripheral surface of the force accumulation spiral spring housing portion 130*a* is in contact externally with the rope reel 15 at a position farther from the rotational center axis C than the inner cylinder portion 16*a* of the cam plate 16. This can reliably prevent the rope reel 15 from being inclined with respect to the rotational center axis C.

Furthermore, in the present first preferred embodiment, the rewind spiral spring 18 is disposed so as to overlap the force accumulation spiral spring 17 in the direction of the crankshaft, as mentioned above. That is, the rewind spiral spring 18 and the force accumulation spiral spring 17 are arranged in a vertically overlapped manner. It is therefore possible to minimize and prevent the lateral expansion of the space that is occupied by the spiral springs over the plate 15*d*. This allows the engine cover 7, which is provided to cover the engine 2 and the spiral springs, etc., to have a round-off shape.

Also, in the present first preferred embodiment, the outside diameter D1 of the force accumulation spiral spring 17 is smaller than the outside diameter D2 of the rewind spiral spring 18, as mentioned above. With this arrangement, the rope reel 15, rewind spiral spring 18, and force accumulation spiral spring 17 can be disposed in descending order of diameter from bottom to top. This allows the engine cover 7 to have a round-off shape.

Additionally, in the present first preferred embodiment, because the plate 15*d* of the rope reel 15 is disposed lower than the force accumulation spiral spring 17 and the rewind spiral spring 18 as mentioned above, the distance between the plate 15*d* and the handle 12 is short. It is therefore possible to dispose the rope winding portion 15*f* at a position near the handle 12 without being extended largely toward the engine 2 from the plate 15*d*. This allows the difference in the height position between the handle 12 and the rope winding portion 15*f* to be reduced while the rope reel 15 is strengthened mechanically.

Because the ceiling wall 71 of the engine cover 7 is slanted toward the front thereof, the flat portion 72*a* of the front wall 72 cannot be disposed at a higher position. Therefore, the height position of the handle housing portion 132 is restricted due to the need for providing a waterproof structure using the seal member 75. Nevertheless, because the rope winding portion 15*f* can be disposed at a lower position closer to the engine 2 without sacrificing the mechanical strength of the rope reel 15, the difference in the height position between the rope winding portion 15*f* and the handle housing portion 132 is small. Therefore, the pulling force applied to the rope 14 can be transmitted efficiently to the rope reel 15 and the rope reel 15 can be rotated stably.

Also, in the present first preferred embodiment, the outside diameter D3 of the rope winding portion 15*f* is smaller than the outside diameter of the flywheel 25 (i.e., the outside diameter D4 of the ring gear 25*a*) that is fixed to the crankshaft 24, as mentioned above. With this arrangement, the size of the engine cover 7 can be reduced. Because the force accumulation spiral spring 17 is provided, the user experiences a reduced resistance at the start of the engine. Therefore, the user does not experience a large resistance at the start of the engine even if the outside diameter of the rope winding portion 15*f* may be smaller than the outside diameter of the flywheel 25 (i.e., the outside diameter D4 of the ring gear 25*a*). This allows the size of the engine cover 7 to be reduced without the user experiencing an increased resistance at the start of the engine 2.

Further, in the present first preferred embodiment, when the rope 14 is pulled, the force accumulation spiral spring 17 is wound up and the operation force by the user can be accumulated in the force accumulation spiral spring 17, as mentioned above. In this case, the engine 2 can be started when the force accumulated in the force accumulation spiral spring 17 exceeds the resistance at the compression point of the engine 2 (top dead center of the pistons 22). The force accumulation spiral spring 17 can be wound up with a force smaller than required to pull the rope 14 to directly rotate the crankshaft 24. Therefore, the engine 2 can be started with a smaller force, which makes it much easier for the user to start the engine.

Also, because the force accumulation spiral spring 17 is provided, only a reduced force is required to pull the rope 14. Therefore, even if the diameter of the rope winding portion 15*f* may be small, the user is not required to apply an excessive force to pull the rope 14. Thus, the engine 2 can be started by pulling the rope 14 with a smaller force and the diameter of the rope winding portion 15*f* may be small. If the diameter of the rope winding portion 15*f* is reduced, the amount of revolution of the engine 2 increases relative to the amount of pulling the rope 14 at engine start, resulting in an improvement in startability.

In addition, if the diameter of the rope winding portion 15*f* is reduced, the distance between the handle 12 and the rope winding portion 15*f* increases, which can reduce the slant angle of the rope 14 from the handle 12 to the rope winding portion 15*f*. This can reduce the frictional force when the rope 14 slides against the guide portion 131 and the handle housing portion 132 of the outboard motor 1 and thereby can minimize and prevent the wear of the rope 14. In the outboard motor 1 according to the first preferred embodiment, the wear of the rope 14 can thus be minimized and prevented while making it much easier for the user to start the engine.

Also, in the present first preferred embodiment, the guide portion 131 and the rope winding portion 15*f* are disposed at the same height position, and the handle housing portion 132 and the handle 12 are disposed at the same height position, as mentioned above. This allows the rope 14 to be guided from the rope winding portion 15*f* to the handle 12 through the guide portion 131 and the handle housing portion 132 even if the height position of the rope winding portion 15*f* may be different from that of the handle 12.

Further, in the present first preferred embodiment, because the force accumulation spiral spring 17 is provided, the diameter of the rope winding portion 15*f* may be reduced, as mentioned above. Therefore, although the extending direction of the rope 14 varies at the guide portion 131 and the handle housing portion 132 when viewed from above, the angle variation of the direction can be reduced. This can reduce the horizontal frictional force by the guide portion 131 and the handle housing portion 132 even if it may be applied to the rope 14, whereby the wear of the rope 14 can be minimized and prevented.

Furthermore, in the present first preferred embodiment, the handle 12 on the rope 14 and the handle housing portion 132 are disposed on a lateral portion (front wall 72) of the engine cover 7 on the side of the hull 100, and the rope winding portion 15*f* and the guide portion 131 are disposed in the vicinity of the upper surface of the engine cover 7, as mentioned above. Then, the height position of the handle 12 is different from that of the rope winding portion 15*f*. Therefore, the friction between the rope 14 and the guide portion 131 as well as the handle housing portion 132 is unavoidable. Even in such an arrangement, the user is required to apply only a relatively small operation force to pull the rope 14 due to the function of the force accumulation spiral spring 17. Consequently, the wear of the rope 14 can be minimized and prevented.

Additionally, in the present first preferred embodiment, the guide portion 131 and the handle housing portion 132 are formed integrally with the recoil case 13, as mentioned above. This allows the number of components to be reduced.

Also, in the present first preferred embodiment, the force accumulation spiral spring 17 and the rewind spiral spring 18 are disposed above the plate 15*d* of the rope reel 15, as mentioned above. This allows the height position of the rope winding portion 15*f* to be arranged at a lower position without sacrificing the mechanical strength of the rope reel 15. In addition, the diameter of the rope winding portion 15*f* can be reduced. As a result, the slant angle of the rope 14 from the rope winding portion 15*f* to the handle 12 can be reduced, whereby the wear of the rope 14 can be minimized and prevented.

Second Preferred Embodiment

Figure 7:
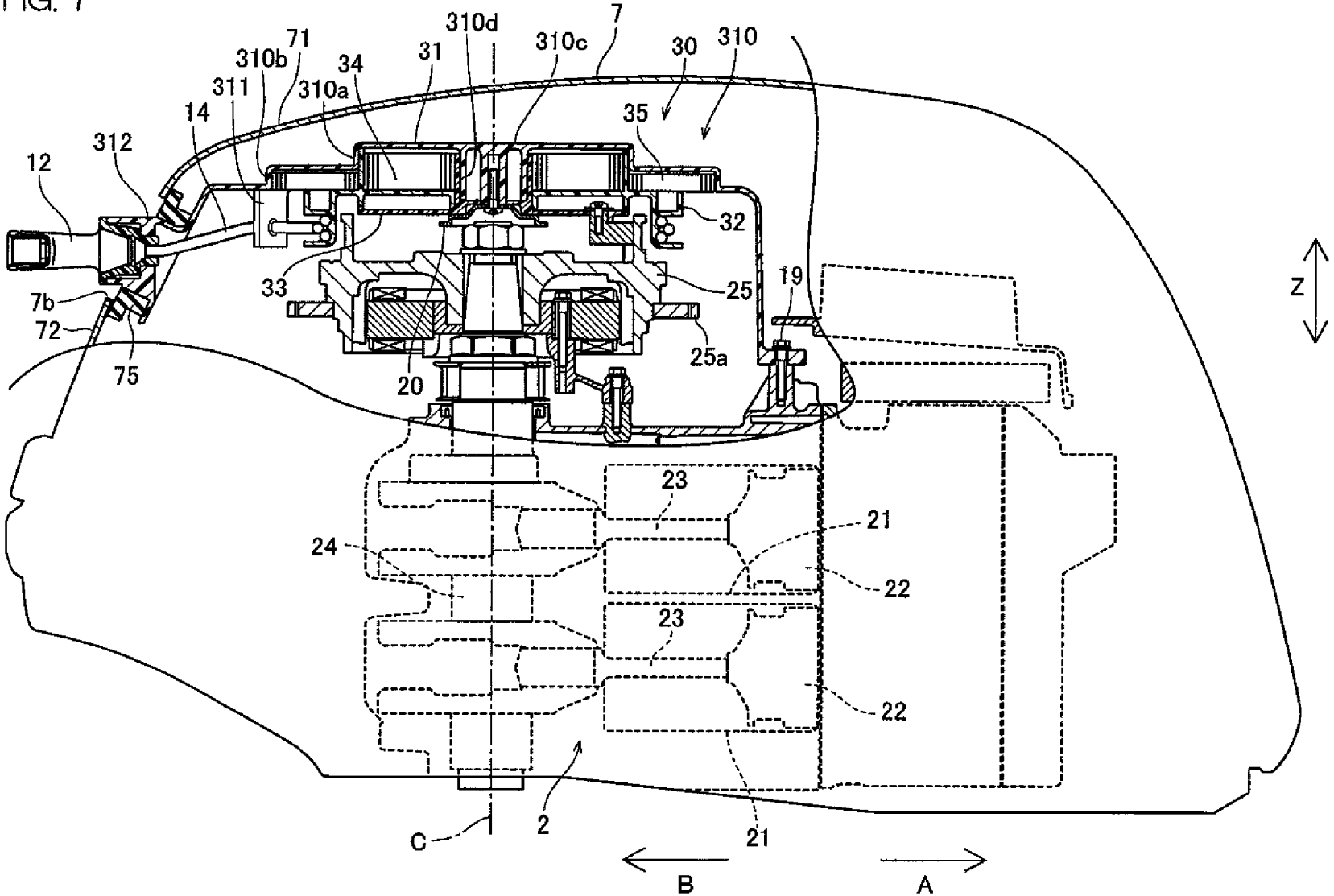
FIG. 7 is a partial cross-sectional view showing the arrangement inside the engine cover of an outboard motor according to a second preferred embodiment of the present invention.
Figure 8:
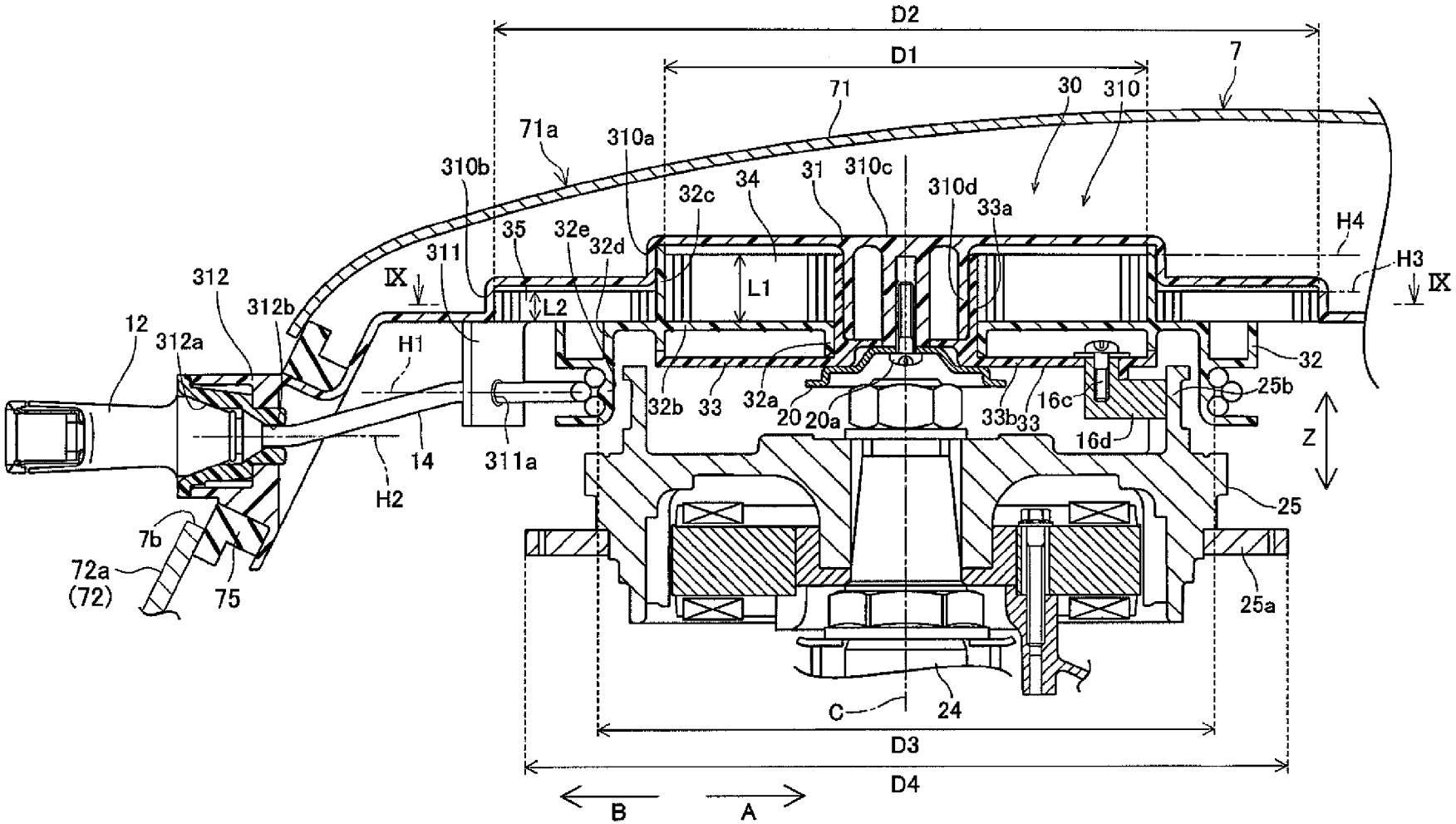
FIG. 8 is an enlarged cross-sectional view showing a portion of the arrangement shown in FIG. 7 in an enlarged manner.

FIGS. 7 and 8 illustrate the detailed structure of an outboard motor according to a second preferred embodiment of the present invention. In FIGS. 7 and 8, components similar to those in the first preferred embodiment are designated by the same reference numerals. In the first preferred embodiment, the force accumulation spiral spring 17 and the rewind spiral spring 18 are disposed in a vertically overlapped manner, while in the present second preferred embodiment, a force accumulation spiral spring 34 and a rewind spiral spring 35 are disposed in a laterally overlapped manner.

An engine starter 30 arranged to manually start the engine 2 is disposed above the flywheel 25. The engine starter 30 includes a recoil case 31, a rope reel 32, a cam plate 33, a force accumulation spiral spring 34, and a rewind spiral spring 35. The recoil case 31 is fixed to the engine 2 to be non-rotational with respect to the engine 2 and the engine cover 7. The rope reel 32 is arranged to be wound with the rope 14 as well as to be rotatable about the rotational center axis C of the crankshaft 24. The cam plate 33 is arranged to be rotatable about the rotational center axis C. The force accumulation spiral spring 34 is arranged to accumulate a torque applied by the rope reel 32. The rewind spiral spring 35 is arranged to rewind the rope 14 in a pulled-out state. The recoil case 31 and the cam plate 33 are, respectively, examples of a "fixed member" and a "transmitting member" according to one preferred embodiment of the present invention.

The recoil case 31 is fixed to the upper surface of the engine 2 using a screw 19, for example. The recoil case 31 is preferably made of, for example, resin material and has a housing portion 310, a guide portion 311, and a handle housing portion 312 that are formed integrally. The housing portion 310 is arranged to house therein the rope reel 32, cam plate 33, force accumulation spiral spring 34, and rewind spiral spring 35, etc. The guide portion 311 is arranged to guide the rope 14 to be pulled out and rewound. The handle housing portion 312 is arranged to house and hold therein the handle 12 on the rope 14.

The housing portion 310 includes a force accumulation spiral spring housing portion 310*a* arranged to house therein the force accumulation spiral spring 34 and a rewind spiral spring housing portion 310*b* arranged to house therein the rewind spiral spring 35. The housing portion 310 further includes a rotary shaft portion 310*d* protruding downward from the upper surface portion 310*c* and arranged to rotatably support the rope reel 32 and the cam plate 33. The rewind spiral spring 35 is disposed so as to surround the force accumulation spiral spring 34. The height position H3 of the upper end surface of the rewind spiral spring 35 is lower than the height position H4 of the upper end surface of the force accumulation spiral spring 34. The force accumulation spiral spring housing portion 310*a* is an example of a "support wall portion" according to one preferred embodiment of the present invention.

The rope reel 32 is preferably made of, for example, resin material and includes a cylindrical inner cylinder portion 32*a*, a disk-shaped plate 32*b*, a cylindrical standing wall portion 32*c*, a stepped portion 32*d*, and a rope winding portion 32*e* that are formed integrally. The plate 32*b* is arranged so as to extend outward from the upper end portion of the inner cylinder portion 32*a*. The standing wall portion 32*c* protrudes upward from the plate 32*b*. The stepped portion 32*d* is arranged so as to extend downward from the outer peripheral portion of the plate 32*b*. The rope winding portion 32*e* is provided at the peripheral edge of the stepped portion 32*d*. The plate 32*b* is an example of a "plate portion" according to one preferred embodiment of the present invention.

The cam plate 33 is preferably made of, for example, resin material and includes a cylindrical inner cylinder portion 33*a* and a plate 33*b* disposed in the lower portion of the inner cylinder portion 33*a*. The inner cylinder portion 33*a* of the cam plate 33 is fitted rotatably on the rotary shaft portion 310*d* of the recoil case 31. The inner cylinder portion 32*a* of the rope reel 32 is fitted rotatably on the inner cylinder portion 33*a* of the cam plate 33. The outer peripheral surface of the cylindrical standing wall portion 32*c* of the rope reel 32 is supported by the inner peripheral surface of the force accumulation spiral spring housing portion 310*a*.

The force accumulation spiral spring 34 and the rewind spiral spring 35 are both disposed on the opposite side of the engine 2 with respect to the plate 32*b* of the rope reel 32. Specifically, the force accumulation spiral spring 34 is disposed in a space that is surrounded by the plate 32*b* and standing wall portion 32*c* of the rope reel 32, inner cylinder portion 33*a* of the cam plate 33, and upper surface portion 310*c* of the recoil case 31. The rewind spiral spring 35 is disposed in a space that is surrounded by the plate 32*b* and standing wall portion 32*c* of the rope reel 32 and the rewind spiral spring housing portion 310*b*. The rewind spiral spring 35 and the force accumulation spiral spring 34 are thus disposed in a laterally overlapped manner.

Figure 9:
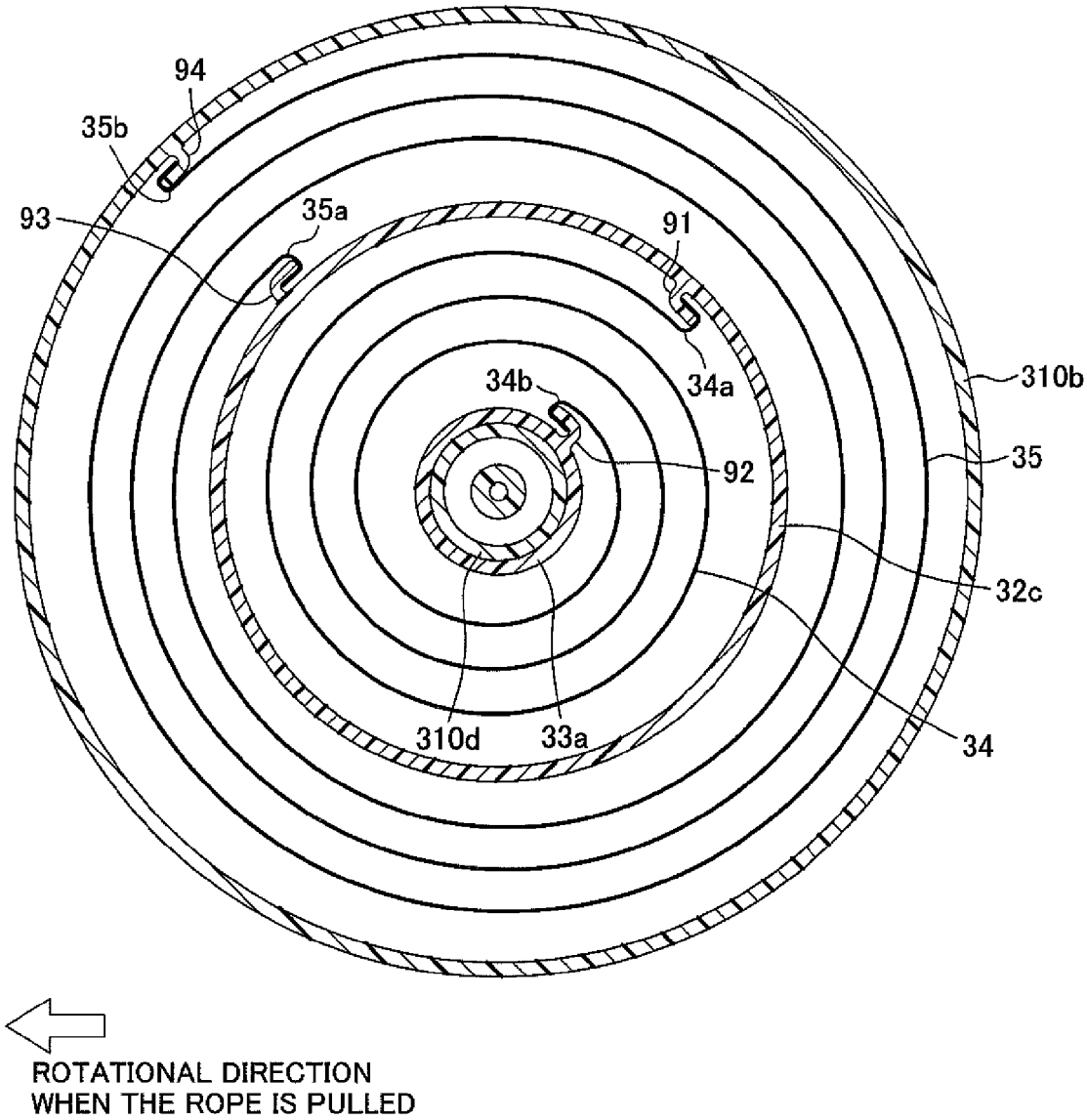
FIG. 9 is a cross-sectional view along the section line IX-IX in FIG. 8.

FIG. 9 is a cross-sectional view along the section line IX-IX in FIG. 8. One end (outer end) 34*a* and the other end (inner end) 34*b* of the force accumulation spiral spring 34 are fixed, respectively, to the inner surface of the cylindrical standing wall portion 32*c* of the rope reel 32 and the outer surface of the inner cylinder portion 33*a* of the cam plate 33. More specifically, the outer end 34*a* and the inner end 34*b* each preferably have a hook shape. Hooks 91 and 92 are provided, respectively, on the inner surface of the standing wall portion 32*c* and the outer surface of the inner cylinder portion 33*a*. The outer end 34*a* and the inner end 34*b* are engaged, respectively, with the hooks 91 and 92. Also, one end (inner end) 35*a* and the other end (outer end) 35*b* of the rewind spiral spring 35 are fixed, respectively, to the outer surface of the standing wall portion 32*c* of the rope reel 32 and the inner surface of the rewind spiral spring housing portion 310*b*. More specifically, the inner end 35*a* and the outer end 35*b* each preferably have a hook shape. Hooks 93 and 94 are provided, respectively, on the outer surface of the standing wall portion 32*c* and the inner surface of the rewind spiral spring housing portion 310*b*. The inner end 35*a* and the outer end 35*b* are engaged, respectively, with the hooks 93 and 94.

The structures of the guide portion 311 (including a guide hole 311*a*) and the handle housing portion 312 (including a holding portion 312*a* and a guide hole 312*b*) are substantially the same as those of the guide portion 131 (including guide hole 131*a*) and the handle housing portion 132 (including holding portion 132*a* and guide hole 132*b*) in the first preferred embodiment.

The arrangement of the second preferred embodiment other than described above is the same as that of the first preferred embodiment.

In the present second preferred embodiment, the rewind spiral spring 35 is disposed so as to surround the outer periphery of the force accumulation spiral spring 34, as mentioned above. With this arrangement, the height of the outboard motor (i.e., the height of the engine cover 7) can be reduced, unlike the case where the rewind spiral spring 35 and the force accumulation spiral spring 34 are provided in a vertically overlapped manner.

Also, in the present second preferred embodiment, the height position H3 of the upper end surface of the rewind spiral spring 35 is lower than the height position H4 of the upper end surface of the force accumulation spiral spring 34, as mentioned above. With this arrangement, the profile line formed by the rope reel 32, rewind spiral spring 35, and force accumulation spiral spring 34 may narrow from bottom to top. This allows the engine cover 7 to have a round-off shape.

Other advantages of the second preferred embodiment include those of the above-described first preferred embodiment.

Third Preferred Embodiment

Figure 10:
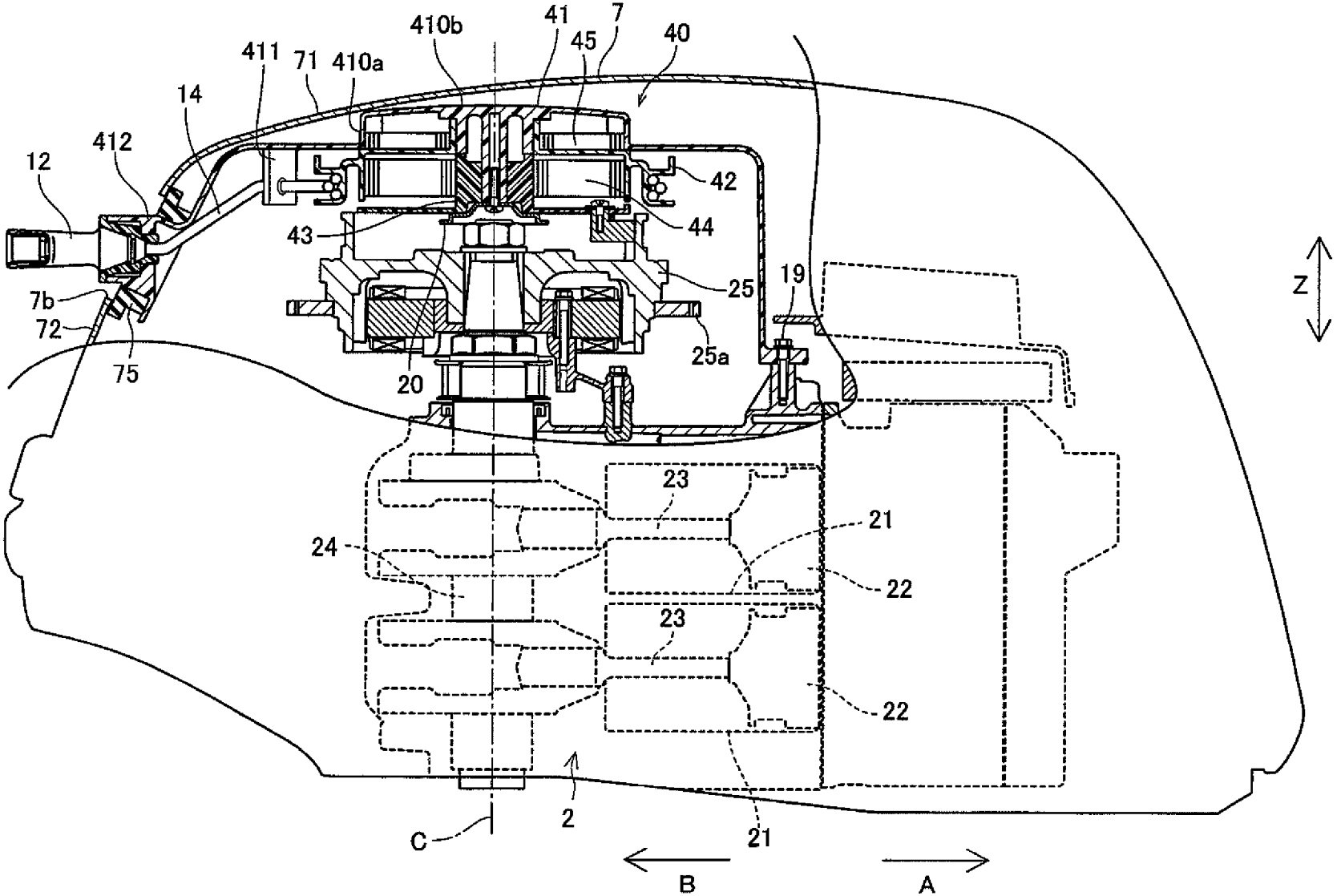
FIG. 10 is a partial cross-sectional view showing the structure inside the engine cover of an outboard motor according to a third preferred embodiment of the present invention.
Figure 11:
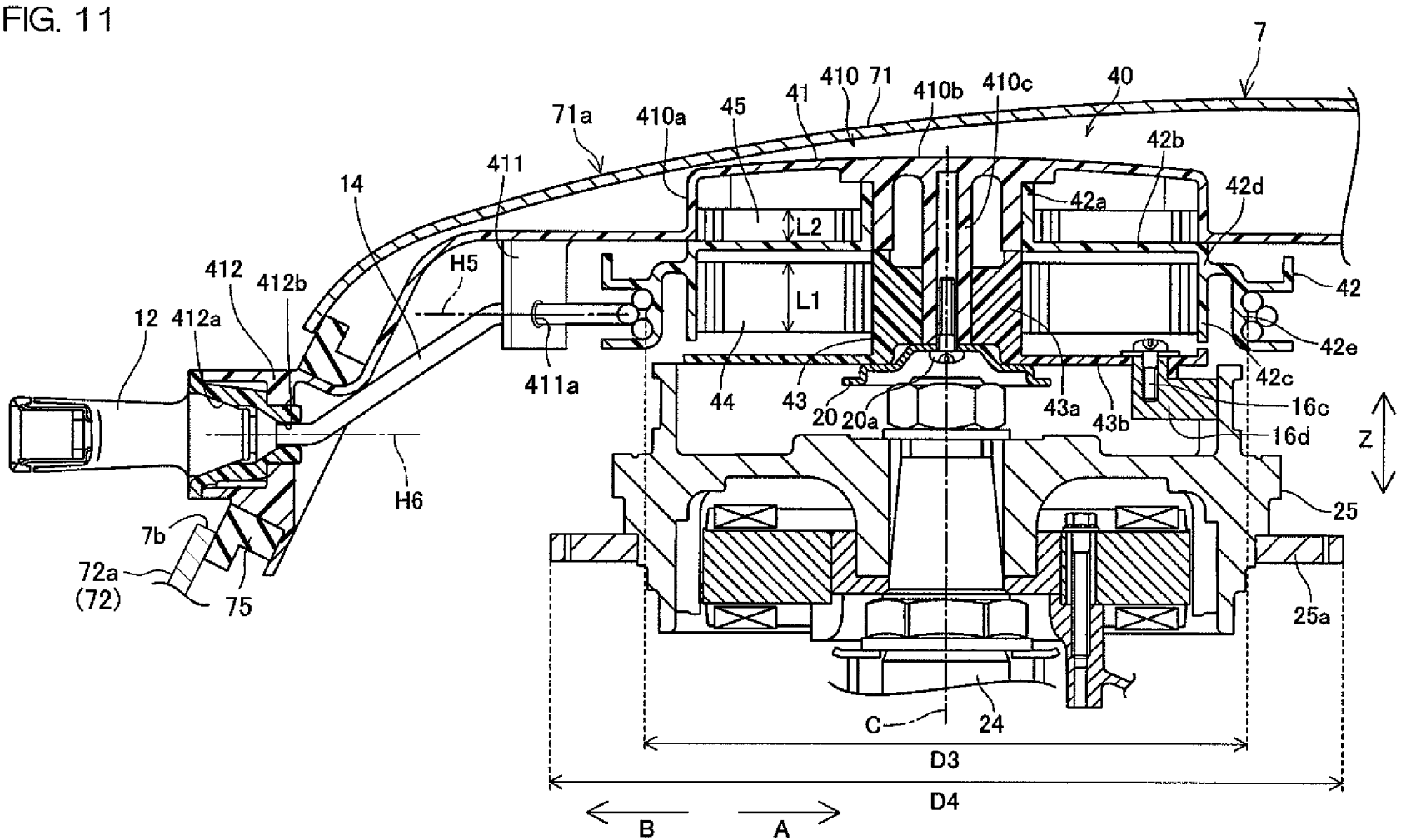
FIG. 11 is an enlarged cross-sectional view showing a portion of the arrangement shown in FIG. 10 in an enlarged manner.

FIGS. 10 and 11 illustrate the detailed structure of an outboard motor according to a third preferred embodiment of the present invention. In FIGS. 10 and 11, components similar to those in the first preferred embodiment are designated by the same reference numerals. In the present third preferred embodiment, a rewind spiral spring 45 is disposed above a plate portion (plate 42*b*) and a force accumulation spiral spring 44 is disposed below the plate portion (plate 42*b*).

An engine starter 40 arranged to manually start the engine 2 is disposed above the flywheel 25. The engine starter 40 includes a recoil case 41, a rope reel 42, a cam plate 43, a force accumulation spiral spring 44, and a rewind spiral spring 45. The recoil case 41 is fixed to the engine 2 to be non-rotational with respect to the engine 2 and the engine cover 7. The rope reel 42 is arranged to be wound with the rope 14 as well as to be rotatable about the rotational center axis C of the crankshaft 24. The cam plate 43 is arranged to be rotatable about the rotational center axis C. The force accumulation spiral spring 44 is arranged to accumulate a torque applied by the rope reel 42. The rewind spiral spring 45 is arranged to rewind the rope 14 in a pulled-out state. The recoil case 41 and the cam plate 43 are, respectively, examples of a "fixed member" and a "transmitting member" according to one preferred embodiment of the present invention.

The recoil case 41 is made of, for example, resin material and is fixed to the upper surface of the engine 2 using a screw 19, for example. The recoil case 41 includes a housing portion 410, a guide portion 411, and a handle housing portion 412 that are formed integrally. The housing portion 410 is arranged to house therein the rope reel 42 and the rewind spiral spring 45, etc. The guide portion 411 is arranged to guide the rope 14 to be pulled out and rewound. The handle housing portion 412 is arranged to house and hold therein the handle 12 on the rope 14.

The housing portion 410 includes a rewind spiral spring housing portion 410*a* arranged to house therein the rewind spiral spring 45 and a rotary shaft portion 410*c* arranged to rotatably support the rope reel 42 and the cam plate 43. The rotary shaft portion 410*c* protrudes downward from the upper surface portion 410*b* of the housing portion 410.

The rope reel 42 is preferably made of, for example, resin material and includes a cylindrical inner cylinder portion 42*a*, a plate 42*b*, a cylindrical standing wall portion 42*c*, a stepped portion 42*d*, and a rope winding portion 42*e* that are formed integrally. The plate 42*b* is arranged so as to extend outward from the lower end portion of the inner cylinder portion 42*a*. The standing wall portion 42*c* protrudes downward from the outer peripheral portion of the plate 42*b*. The stepped portion 42*d* extends downward from the outer peripheral portion of the plate 42*b* and further extends outward. The rope winding portion 42*e* is provided at the peripheral edge of the stepped portion 42*d*. The plate 42*b* is an example of a "plate portion" according to one preferred embodiment of the present invention.

The cam plate 43 is preferably made of, for example, resin material and includes a cylindrical inner cylinder portion 43*a* and a plate 43*b* disposed in the lower portion of the inner cylinder portion 43*a*. The inner cylinder portion 43*a* of the cam plate 43 is fitted rotatably on the rotary shaft portion 410*c* (inner rotary shaft portion) of the recoil case 41. The inner cylinder portion 42*a* of the rope reel 42 is also fitted rotatably on the rotary shaft portion 410*c* (outer rotary shaft portion) of the recoil case 41.

The rewind spiral spring 45 is disposed on the opposite side of the engine 2 with respect to the plate 42*b* of the rope reel 42, while the force accumulation spiral spring 44 is disposed lower (closer to the engine 2) than the plate 42*b* of the rope reel 42. Specifically, the force accumulation spiral spring 44 is disposed in a space that is surrounded by the plate 42*b* and standing wall portion 42*c* of the rope reel 42 and the inner cylinder portion 43*a* and plate of the cam plate 43. Also, the rewind spiral spring 45 is disposed in a space that is surrounded by the inner cylinder portion 42*a* and plate 42*b* of the rope reel 42 and the rewind spiral spring housing portion 410*a*.

First and second ends of the force accumulation spiral spring 44 are fixed, respectively, to the inner surface of the cylindrical standing wall portion 42*c* of the rope reel 42 and the outer surface of the inner cylinder portion 43*a* of the cam plate 43. Also, first and second ends of the rewind spiral spring 45 are fixed, respectively, to the outer surface of the inner cylinder portion 42*a* of the rope reel 42 and the inner surface of the rewind spiral spring housing portion 410*a*.

In the present third preferred embodiment, the rope winding portion 42*e* and the guide hole 411*a* in the guide portion 411 are disposed at the same height position H5. The holding portion 412*a* and the guide hole 412*b* of the handle housing portion 412 are disposed at the same height position H6. The height position H6 of the holding portion 412*a* and the guide hole 412*b* is lower than the height position H5 of the rope winding portion 42*e* and the guide hole 411*a*. Also, in the present third preferred embodiment, because the force accumulation spiral spring 44 is disposed lower than the plate 42*b* of the rope reel 42, the plate 42*b* and the rope winding portion 42*e*, etc., are accordingly disposed at a higher position than in the first and second preferred embodiments. Therefore, the difference between the height position H5 of the rope winding portion 42*e* and the height position H6 of the handle housing portion 412 in the third preferred embodiment is greater than the difference between the height position H1 of the rope winding portion and the height position H2 of the handle housing portion in the first and second preferred embodiments.

The arrangement of the third preferred embodiment other than described above is substantially the same as that of the first preferred embodiment.

Further, in the present third preferred embodiment, because the force accumulation spiral spring 44 is provided, the diameter of the rope winding portion 42*e* may be reduced. As a result, the slant angle of the rope 14 can be reduced, whereby the wear of the rope 14 can be minimized and prevented.

Other Preferred Embodiments

The above-disclosed preferred embodiments are to be considered in all aspects only as illustrative and not restrictive. The scope of the present invention is not defined by the above-described preferred embodiments, but rather by the claims appended hereto. Further, the present invention includes all the modifications within the meaning and scope equivalent to those defined by the appended claims.

For example, although the first preferred embodiment above describes the case where the force accumulation spiral spring 17 is disposed on the opposite side of the engine 2 than the rewind spiral spring 18, the present invention is not restricted thereto. That is, the force accumulation spiral spring 17 may be disposed closer to the engine 2 than the rewind spiral spring 18. Although the second preferred embodiment above describes the case where the rewind spiral spring 35 is preferably disposed so as to surround the outer periphery of the force accumulation spiral spring 34, the present invention is not restricted thereto. That is, the force accumulation spiral spring 34 may be disposed so as to surround the outer periphery of the rewind spiral spring 35. Further, the force accumulation spiral spring and the rewind spiral spring may not be provided in a vertically or laterally overlapped manner.

Although the third preferred embodiment above describes the case where the force accumulation spiral spring is preferably disposed below the plate portion and the rewind spiral spring is disposed above the plate portion, the present invention is not restricted thereto. That is, the force accumulation spiral spring may be disposed above the plate portion and the rewind spiral spring may be disposed below the plate portion.

Although the first and second preferred embodiments above describe the case where the force accumulation spiral spring and the rewind spiral spring are both preferably disposed on the opposite side of the engine 2 with respect to the plate portion, the present invention is not restricted thereto. That is, the rewind spiral spring may be disposed closer to the engine 2 than the plate portion. Because the width (height) of the rewind spiral spring is not large, the amount of the rope winding portion extending from the plate portion can be reduced even if the rewind spiral spring may be disposed closer to the engine 2 than the plate portion.

Although the first and second preferred embodiments above describe the case where the outer peripheral surface of the lateral face (standing wall portion 15*c* or 32*c*) of the rope reel on which one end of the force accumulation spiral spring is fixed is preferably supported externally by the recoil case, the present invention is not restricted thereto. That is, any portion of the rope reel may be supported externally by the recoil case.

Also, in the first to third preferred embodiments above, the extending direction of the rope preferably varies at the first guide portion and the second guide portion when viewed laterally and also varies at the first guide portion and the second guide portion when viewed from above, the present invention is not restricted thereto. For example, the present invention may be applied to outboard motors in which the extending direction of the rope varies at the first guide portion and the second guide portion when viewed laterally, but does not vary at the first guide portion and the second guide portion when viewed from above.

Although the first to third preferred embodiments above describe the case where two guide portions are preferably provided, the present invention is not restricted thereto, and one or three guide portions may be provided.

Figure 12:
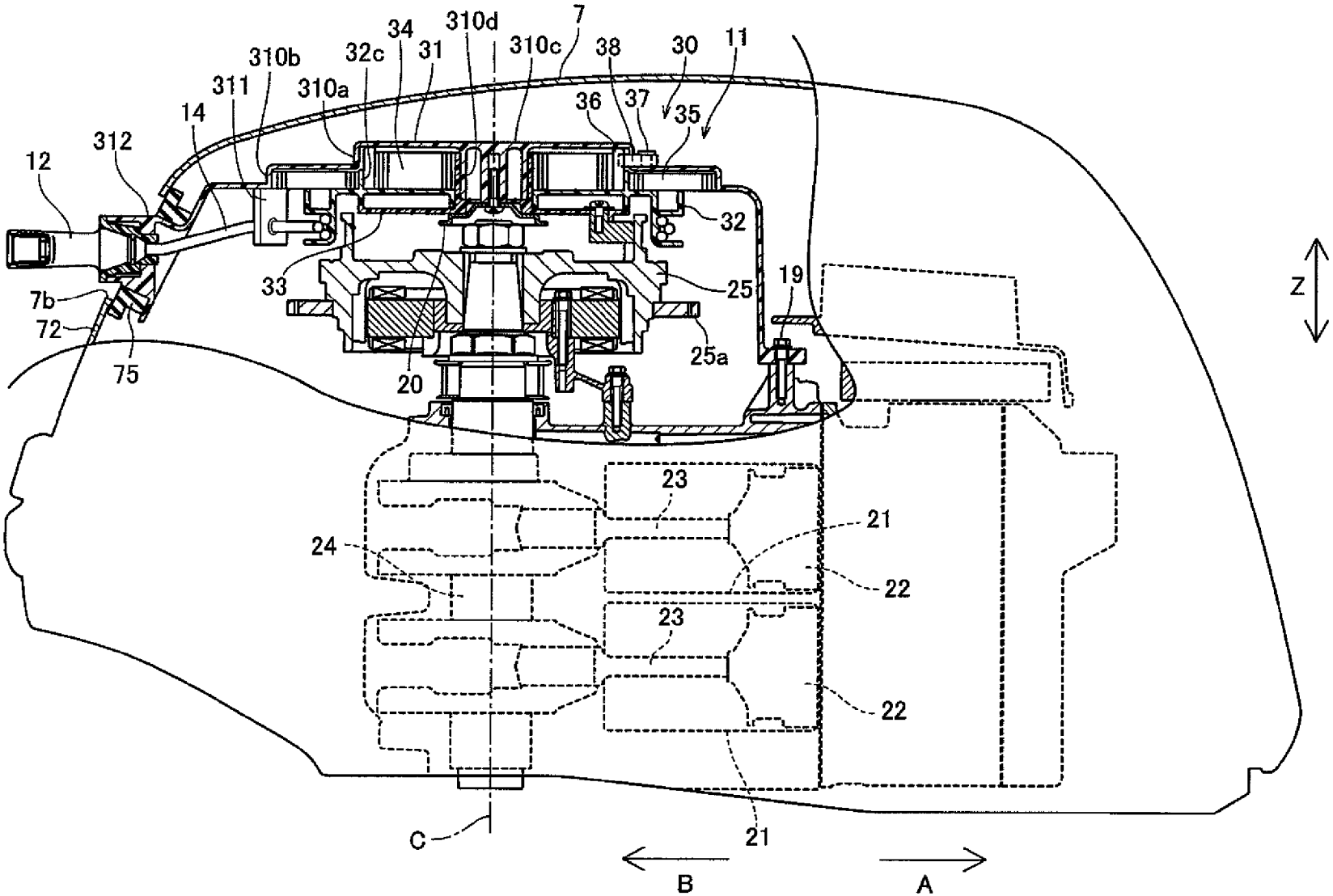
FIG. 12 is a partial cross-sectional view showing the arrangement inside the engine cover of an outboard motor according to an exemplary variation of the second preferred embodiment of the present invention.
Figure 13:
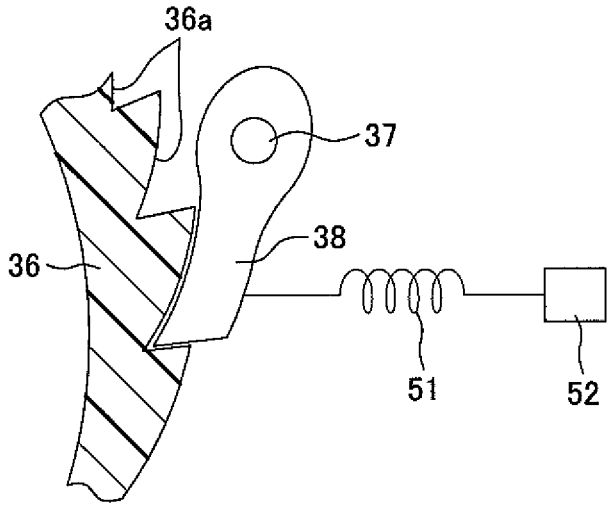
FIG. 13 is a schematic view showing the arrangement of a ratchet mechanism provided in the arrangement shown in FIG. 12.

Although the first and second preferred embodiments above describe the case where the present invention is preferably applied to a so-called acceleration-type recoil starter, the present invention is not restricted thereto. For example, an outboard motor according to an exemplary variation of the above-described second preferred embodiment shown in FIG. 12 may be provided with a ratchet mechanism 50 arranged to prevent the rope reel 15 from being rotated due to a force from the force accumulation spiral spring 34. The ratchet mechanism 50 includes a tubular engageable member 36 fixed to the standing wall portion 32*c* of the rope reel 32 (see FIG. 8) and an engagement nail 38 rotatable about a shaft 37. As schematically shown in FIG. 13, multiple engageable recessed portions 36*a* to be engaged with the engagement nail 38 are arranged circumferentially on the outer surface of the engageable member 36. A release button 52 is coupled to the engagement nail 38 via a link, wire, or another transmitting member 51. The release button 52 is disposed on the lateral side (e.g., front wall 72) of the engine cover 7 so as to be operable by the user. The engagement nail 38 is arranged to turn about the shaft 37 to be disengaged from the engageable recessed portions 36*a* when the release button 52 is operated. Since such a ratchet mechanism 50 is provided, the force accumulated in the force accumulation spiral spring 34 cannot be released even if the handle 12 may be pulled and then put back. It is therefore possible to accumulate a large force in the force accumulation spiral spring 34 by pulling the handle 12 repeatedly several times. When the release button 52 is operated afterwards, the large force accumulated in the force accumulation spiral spring 34 is released to rotate the crankshaft 24 via the flywheel 25 and other components, and thus the engine 2 can be started.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

The present application corresponds to Japanese Patent Application Nos. 2008-308863 and 2008-308868 both filed in the Japan Patent Office on Dec. 3, 2008, and the entire disclosures of these two applications are incorporated herein by reference.

What is claimed is:

1. An outboard motor comprising:

an engine including a vertically extending crankshaft;

a rope reel including a plate portion arranged to be rotatable about a rotational center axis of the crankshaft, and a rope winding portion provided integrally with the plate portion at a peripheral edge thereof, the rope winding portion arranged to be wound with a rope to start the engine;

a transmitting member arranged to be rotatable about the rotational center axis of the crankshaft and to transmit rotation to the crankshaft;

a force accumulation spiral spring disposed on an opposite side of the engine with respect to the plate portion of the rope reel, and arranged to accumulate a torque applied to the rope reel and transmit the torque to the transmitting member, first and second ends of the force accumulation spiral spring being fixed, respectively, to the rope reel and the transmitting member;

an engine cover arranged to cover the engine, the rope reel, the transmitting member, and the force accumulation spiral spring;

a fixed member fixed non-rotationally with respect to the engine; and a rewind spiral spring disposed on the opposite side of the engine with respect to the plate portion of the rope reel and arranged to rewind the rope, first and second ends of the rewind spiral spring being fixed, respectively, to the rope reel and the fixed member.

2. The outboard motor according to claim 1, wherein the rope reel further includes a cylindrical standing wall portion, the fixed member includes a cylindrical support wall portion, and an outer peripheral surface of the cylindrical standing wall portion of the rope reel is supported externally and rotatably by an inner peripheral surface of the cylindrical support wall portion of the fixed member.

3. The outboard motor according to claim 2, wherein one end of the force accumulation spiral spring is fixed to an inner peripheral surface of the cylindrical standing wall portion of the rope reel.

4. The outboard motor according to claim 1, wherein the rewind spiral spring is disposed closer to the engine than the force accumulation spiral spring so as to overlap the force accumulation spiral spring in an extending direction of the crankshaft.

5. The outboard motor according to claim 4, wherein an outside diameter of the force accumulation spiral spring is smaller than an outside diameter of the rewind spiral spring.

6. The outboard motor according to claim 1, wherein the rewind spiral spring is disposed so as to surround an outer periphery of the force accumulation spiral spring.

7. The outboard motor according to claim 6, wherein a height of an end surface of the rewind spiral spring on the opposite side of the engine is smaller than a height of an end surface of the force accumulation spiral spring on the opposite side of the engine.

8. The outboard motor according to claim 1, wherein the rope includes a handle disposed on a lateral portion of the engine cover, the rope winding portion is disposed closer to the engine than the rewind spiral spring and the force accumulation spiral spring, and the handle is disposed closer to the engine than the rope winding portion.

9. The outboard motor according to claim 8, wherein the engine cover includes a ceiling wall including a slanting portion slanted downward toward a front thereof, and a front wall coupled to a front edge of the ceiling wall and including a flat portion, the outboard motor further comprising:

a handle housing portion disposed in the flat portion and arranged to house the handle therein; and a seal member disposed between the handle housing portion and an inner wall surface of the flat portion.

10. The outboard motor according to claim 1, wherein an outside diameter of the rope winding portion is smaller than an outside diameter of a flywheel fixed to the crankshaft.

11. The outboard motor according to claim 1, wherein a width of the force accumulation spiral spring is greater than a width of a rewind spiral spring.

* * * * *